US008028766B2

(12) United States Patent
Moore

(10) Patent No.: US 8,028,766 B2
(45) Date of Patent: Oct. 4, 2011

(54) ELECTRICALLY POWERED TRACTOR

(75) Inventor: Norman Bruce Moore, Aliso Viejo, CA (US)

(73) Assignee: WWT International, Inc., Anaheim, CA (US)

( * ) Notice: Subject to any disclaimer, the term of this patent is extended or adjusted under 35 U.S.C. 154(b) by 0 days.

(21) Appl. No.: 12/840,166

(22) Filed: Jul. 20, 2010

(65) Prior Publication Data

US 2011/0067926 A1 Mar. 24, 2011

Related U.S. Application Data

(63) Continuation of application No. 12/139,385, filed on Jun. 13, 2008, now Pat. No. 7,770,667.

(60) Provisional application No. 60/944,078, filed on Jun. 14, 2007, provisional application No. 60/934,784, filed on Jun. 15, 2007, provisional application No. 60/964,788, filed on Aug. 14, 2007.

(51) Int. Cl.
*E21B 4/18* (2006.01)
*E21B 4/04* (2006.01)

(52) U.S. Cl. ..... 175/98; 175/51; 175/97; 175/104; 175/230; 166/216

(58) Field of Classification Search ..... 175/51, 175/97, 98, 230, 104; 166/216, 217
See application file for complete search history.

(56) References Cited

U.S. PATENT DOCUMENTS

| | | | |
|---|---|---|---|
| 3,298,449 | A | 1/1967 | Bachman et al. |
| 3,430,698 | A | 3/1969 | Urbanosky |
| 3,497,019 | A | 2/1970 | Ortloff |
| 3,587,757 | A | 6/1971 | Herring |
| 3,661,205 | A | 5/1972 | Belorgey |
| 3,690,375 | A | 9/1972 | Shillander |
| 4,116,274 | A | 9/1978 | Rankin et al. |
| 4,124,070 | A | 11/1978 | King et al. |
| 4,243,099 | A | 1/1981 | Rodgers, Jr. |
| 4,441,361 | A | 4/1984 | Carlson et al. |
| RE31,607 | E | 6/1984 | Vogel et al. |

(Continued)

FOREIGN PATENT DOCUMENTS

| | | |
|---|---|---|
| GB | 2241723 | 9/1991 |

(Continued)

OTHER PUBLICATIONS

International Preliminary Report on Patentability dated Sep. 30, 2010 in International Application No. PCT/US2008/067016.

(Continued)

*Primary Examiner* — Giovanna Wright
(74) *Attorney, Agent, or Firm* — Knobbe Martens Olson & Bear LLP

(57) ABSTRACT

An electrically powered and controlled tractor system includes one or more electric gripper assemblies and one or more electric power train assemblies. Power and control signals for the gripper assemblies and power train assemblies can be delivered from a ground surface via a wireline. The gripper assembly employs a motor-activated lead screw and nut combination to expand passage-gripping elements, preferably by pushing the gripping elements radially outward from locations between opposing ends of the gripping elements. A failsafe mechanism can retract the gripping elements during a power interruption. The power train assembly employs a motor-activated lead screw and nut combination to expand and contract two or more telescoping members. The tractor system can include multiple tractor units that each includes one gripper assembly and one power train assembly. A tractor can include one power train assembly and two gripper assemblies.

12 Claims, 17 Drawing Sheets

U.S. PATENT DOCUMENTS

| | | | |
|---|---|---|---|
| 4,715,469 | A | 12/1987 | Yasuda et al. |
| 5,311,954 | A | 5/1994 | Quintana |
| 5,316,094 | A | 5/1994 | Pringle |
| 5,328,180 | A | 7/1994 | Benavides et al. |
| 5,394,951 | A | 3/1995 | Pringle et al. |
| 5,613,568 | A | 3/1997 | Sterner et al. |
| 5,794,703 | A | 8/1998 | Newman et al. |
| 5,954,131 | A | 9/1999 | Sallwasser |
| 6,003,606 | A | 12/1999 | Moore et al. |
| 6,026,911 | A | 2/2000 | Angle et al. |
| 6,241,031 | B1 | 6/2001 | Beaufort et al. |
| 6,315,075 | B1 | 11/2001 | Nakajima |
| 6,347,674 | B1 | 2/2002 | Bloom et al. |
| 6,464,003 | B2 | 10/2002 | Bloom et al. |
| 6,629,568 | B2 | 10/2003 | Post et al. |
| 6,655,458 | B2 | 12/2003 | Kurkjian et al. |
| 6,679,341 | B2 | 1/2004 | Bloom et al. |
| 6,715,559 | B2 | 4/2004 | Bloom et al. |
| 6,868,901 | B2 | 3/2005 | Mason et al. |
| 6,910,533 | B2 | 6/2005 | Guerrero |
| 6,920,936 | B2 | 7/2005 | Sheiretov et al. |
| 7,121,364 | B2 | 10/2006 | Mock et al. |
| 7,252,143 | B2 | 8/2007 | Sellers et al. |
| 7,392,859 | B2 | 7/2008 | Mock et al. |
| 2005/0139357 | A1 | 6/2005 | Martin et al. |
| 2006/0249307 | A1 | 11/2006 | Ritter et al. |
| 2007/0095532 | A1 | 5/2007 | Head et al. |
| 2007/0209806 | A1 | 9/2007 | Mock |
| 2008/0149339 | A1 | 6/2008 | Krueger |

FOREIGN PATENT DOCUMENTS

| | | | |
|---|---|---|---|
| WO | WO 2008/024881 | A1 | 2/2008 |

OTHER PUBLICATIONS

International Search Report and Written Opinion dated Sep. 21, 2010 in International Application No. PCT/US2008/067016.

ELECTRICALLY POWERED TRACTOR

CROSS-REFERENCE TO RELATED APPLICATIONS

This application is a continuation of application Ser. No. 12/139,385, filed Jun 13, 2008, now U.S. Pat. No. 7,770,667 issued Aug. 10, 2010, which claims priority to Provisional Application No. 60/944,078, filed Jun. 14, 2007; Provisional Application No. 60/934,784, filed Jun. 15, 2007; and Provisional Application No. 60/964,788, filed Aug 14, 2007.

INCORPORATION BY REFERENCE

This application incorporates by reference the entire disclosures of the following: U.S. Pat. No. 6,003,606 to Moore et al.; U.S. Pat. No. 6,241,031 to Beaufort et al.; U.S. Pat. No. 6,347,674 to Bloom et al.; U.S. Pat. No. 6,679,341 to Bloom et al.; U.S. Pat. No. 7,121,364 to Mock et al.; U.S. Pat. No. 6,464,003 to Bloom et al.; U.S. Pat. No. 7,624,808 to Mock; U.S. Pat. No. 7,748,476 to Krueger, V; and U.S. Pat. No. 7,770,667 to Moore. This application also incorporates by reference the entire disclosures of Provisional Application No. 60/944,078, filed Jun. 14, 2007; Provisional Application No. 60/934,784, filed Jun. 15, 2007; and Provisional Application No. 60/964,788, filed Aug. 14, 2007.

BACKGROUND

1. Field of the Invention

This application relates generally to electrically powered and controlled tools for moving and operating equipment within passages, such as cased wells and open boreholes.

2. Description of the Related Art

It is known to deploy various types of tools for moving and operating equipment in passages, such as wells and open boreholes. In oil and gas wells, such equipment is often referred to as a "bottom hole assembly" and can perform various functions, which may or may not require fluid for operation. Functions that typically require fluids include drilling, acidizing, and sand washing, and functions that typically do not require fluids include logging of open and cased boreholes, conducting pressure and temperature surveys, and caliper logs.

As used herein, the terms "hole", "passage", "well", and "borehole"are used interchangeably. The inner perimeter of a hole is referred to herein as a "surface", "inner surface", or "wall" of the hole. A cased hole is one that has a casing or metal liner (such as so-called sand screen) formed at its inner surface. An open hole is one that does not have such a casing. As used herein, the term "downhole" refers to the direction pointing away from a ground surface at which a tractor is deployed, and the term "uphole" refers to the direction pointing toward the ground surface.

A tractor is one type of tool that can move and help to operate equipment in passages. A tractor may include an elongated body, one or more gripper assemblies (also sometimes referred to as "grippers") along the body, and one or more propulsion assemblies. Each gripper assembly may have a radially expanded position in which the gripper assembly limits relative movement between the gripper assembly and an inner surface of a passage, well, or borehole. Each gripper assembly can also have a radially retracted position in which the gripper assembly permits substantially free relative movement between the gripper assembly and the inner surface of the passage. Each propulsion assembly can produce longitudinal displacement of the body with respect to one of the gripper assemblies when radially expanded.

In certain implementations, tractors are adapted to walk through a borehole or well. Typically, a first gripper assembly is expanded to grip the hole, and a propulsion assembly propels the tractor body longitudinally with respect to the expanded first gripper assembly. This is referred to as a "power stroke" with respect to the first gripper assembly. Simultaneously, a retracted second gripper assembly is moved longitudinally with respect to the body for a subsequent power stroke. This is referred to as a "reset stroke" with respect to the second gripper assembly. After these power and reset strokes complete, the second gripper assembly is expanded and the first gripper assembly retracts. Then, a propulsion assembly propels the tractor body longitudinally with respect to the expanded second gripper assembly. In other words, the tractor conducts a power stroke with respect to the second gripper assembly. Simultaneously, the retracted first gripper assembly is moved longitudinally with respect to the body for a subsequent power stroke. In other words, the tractor conducts a reset stroke with respect to the first gripper assembly. Tractors that employ this walking method include those described in U.S. Pat. No. 6,003,606 to Moore et al.; U.S. Pat. No. 6,241,031 to Beaufort et al.; U.S. Pat. No. 6,347,674 to Bloom et al.; U.S. Pat. No. 6,679,341 to Bloom et al.; U.S. Pat. No. 7,121,364 to Mock et al.

Many known tools use fluid to expand the gripper assemblies and to propel the tool longitudinally within a borehole or well. In so-called open systems, the fluid is typically pumped from the ground surface to the tool through coiled tubing or jointed pipe that is connected to an aft end of the tool. Such fluid typically exits the tool into the annulus between the tool and the hole wall, and then returns to the ground surface through the borehole or well. In closed systems, the fluid is contained within the tool and simply circulates therein. Fluid-powered tools are particularly useful when the tool's payload (i.e., the equipment that the tool moves through the hole) is heavy, such as perforation guns for forming holes within a well casing. Fluid-powered tools are also useful when the hole that is being serviced is extremely long (e.g., 20,000-35,000 feet).

Other known tools are powered entirely electrically. Such tools are employed within wells, as opposed to open (i.e., uncased) boreholes. Such tools can employ wheels or moving traction belts for gripping and moving with respect to the inner surface of a cased well. Such tools often employ downhole electric motors that perform operations related to moving the tool downhole. Electrical power and signals for propelling and controlling the tool is normally provided through a wireline that extends from the ground surface to the tool, through the well. Electrically powered tools (or "wireline tools") are preferred when payloads are relatively light (e.g., less than 2000 lbs) and the hole to be serviced is not extremely long. Examples of lighter payloads include logging tools and certain pipeline applications.

Tractors push and/or pull a bottom hole assembly through a passage. A tractor utilizing a wireline, coiled tubing, or jointed pipe must also be able to pull it through the passage, including overcoming frictional drag forces thereon.

Certain types of downhole equipment are powered only electrically and controlled only electronically. This equipment is generally more compatible with downhole tools and tractors that are likewise powered only electrically and controlled only electronically. Thus, for many applications, fluid-powered tractors may be less preferred for these compatibility reasons.

SUMMARY

In one aspect, the present application provides a tractor for moving within a passage. The tractor comprises first and second body portions positioned along a longitudinal axis of the tractor, a gripper assembly, and a power train assembly. The gripper assembly comprises a gripper motor, first and second gripper interface portions, and at least two elongated gripping elements engaged with respect to one of the body portions. The gripper motor has an output shaft adapted to rotate about a gripper motor axis during activation of the gripper motor. The first gripper interface portion is oriented substantially along the gripper motor axis, and the second gripper interface portion is in engagement with the first gripper interface portion. One of the first and second gripper interface portions comprises a gripper rotating element configured to rotate about the gripper motor axis during rotation of the output shaft relative to the gripper motor. The other of the first and second gripper interface portions comprises a gripper extension element being configured to move longitudinally with respect to the gripper motor during rotation of the output shaft relative to the gripper motor, due to said engagement between the interface portions. The gripping elements have a movement-limiting mode in which the gripping elements limit relative movement between the gripping elements and an inner surface of a passage, and a movement-permissive mode in which the gripping elements permit substantially free relative longitudinal movement between the gripping elements and the inner surface. The gripper extension element comprises part of a gripper expansion assembly for converting longitudinal motion of the gripper extension element into movement of the gripping elements between said movement-limiting mode and said movement-permissive mode of the gripping elements. The gripper assembly is configured to limit longitudinal movement of one of the body portions relative to the passage when the gripping elements are in said movement-limited mode. The power train assembly comprises a power train motor and a power train subassembly for converting activation of the power train motor into relative longitudinal movement between the first and second body portions.

In another aspect, the present application provides a tractor for moving within a passage. The tractor comprises first and second body portions positioned along a longitudinal axis of the tractor, a first gripper assembly, a motor secured with respect to the first body portion, and first and second interface portions. The first gripper assembly has a movement-limiting mode in which the first gripper assembly limits relative movement between the first gripper assembly and an inner surface of the passage, and a movement-permissive mode in which the first gripper assembly permits substantially free relative movement between the first gripper assembly and the inner surface of the passage. The first gripper assembly is configured to limit longitudinal movement of one of the body portions relative to the passage when the first gripper assembly is in its movement-limiting mode. The motor has an output shaft configured to rotate about a motor axis during activation of the motor. The first interface portion extends substantially along the motor axis, and the second interface portion is in engagement with the first interface portion. One of the first and second interface portions comprises a rotating element coupled with respect to the output shaft of the motor and configured to rotate about the motor axis during rotation of the motor's output shaft relative to a housing of the motor. The other of the first and second interface portions comprises an extension element configured to move longitudinally with respect to the motor during rotation of the motor's output shaft relative to the motor's housing, due to said engagement between the first and second interface portions. The extension element is longitudinally fixed with respect to the second body portion. The rotation of the rotating element about the motor axis causes the extension element to produce relative longitudinal movement between the first and second body portions.

In another aspect, the present application provides a tractor for moving within a passage. The tractor comprises an elongated body portion, a motor, first and second interface portions, an elongated passage-gripping element, and a failsafe mechanism. The motor has an output shaft adapted to rotate about a motor axis during activation of the motor. The first interface portion is oriented substantially along the motor axis, and the second interface portion is in engagement with the first interface portion. One of the first and second interface portions comprises a rotating element configured to rotate about the motor axis during rotation of the motor's output shaft relative to a housing of the motor. The other of the first and second interface portions comprises an extension element configured to move longitudinally with respect to the motor during rotation of the motor's output shaft relative to the motor's housing, due to said engagement of the first and second interface portions.

In this aspect, the gripping element is engaged with respect to the body portion. The gripping element has a movement-limiting mode in which the gripping element limits relative movement between the gripping element and an inner surface of the passage, and a movement-permissive mode in which the gripping element permits substantially free relative movement between the gripping element and the inner surface. The failsafe mechanism is configured to decouple the motor with respect to the rotating element. The extension element comprises part of a gripper expansion assembly for converting longitudinal motion of the extension element into movement of the gripping element between said movement-limiting mode and said movement-permissive mode. The gripper expansion assembly is configured to push the gripping element radially outward at a location of the gripping element that is between opposing ends of the gripping element, in order to bring the gripping element to its movement-limiting mode.

In another aspect, the present application provides a method of moving equipment within a passage. The method comprises providing first and second tractor body portions positioned along a longitudinal axis of the tractor; providing a first gripper interface portion oriented substantially along the gripper motor axis; and providing a second gripper interface portion in engagement with the first gripper interface portion. An output shaft of a gripper motor is rotated about a gripper motor axis. The rotation of the output shaft causes one of the first and second gripper interface portions to rotate about the gripper motor axis. The rotation of the output shaft also causes the other of the first and second gripper interface portions to move longitudinally with respect to the gripper motor, due to said engagement between the first and second gripper interface portions. At least two elongated gripping elements are provided, which are engaged with respect to one of the body portions. The gripping elements have a movement-limiting mode in which the gripping elements limit relative movement between the gripping elements and an inner surface of a passage, and a movement-permissive mode in which the gripping elements permit substantially free relative longitudinal movement between the gripping elements and the inner surface. The longitudinal movement of said other of the first and second gripper interface portions is converted into movement of the gripping elements between said movement-limiting mode and said movement-permissive mode of the gripping elements. The method further comprises limiting longitudinal movement of one of the body portions relative to the passage when the gripping elements are in said movement-limiting mode; rotating an output shaft of a power train motor; and converting the rotation of the output shaft of the power train motor into relative longitudinal movement between the first and second body portions.

In still another aspect, the present application provides a method for moving equipment within a passage. The method comprises providing first and second tractor body portions positioned along a longitudinal axis of the tractor. A first gripper assembly is provided, which has a movement-limiting mode in which the first gripper assembly limits relative movement between the first gripper assembly and an inner surface of the passage, and a movement-permissive mode in which the first gripper assembly permits substantially free relative movement between the first gripper assembly and the inner surface of the passage. The first gripper assembly is brought to its movement-limiting mode so that the first gripper assembly limits longitudinal movement of one of the body portions relative to the passage. The method further comprises providing a motor secured with respect to the first body portion; providing a first interface portion extending substantially along the motor axis; and providing a second interface portion in engagement with the first interface portion. An output shaft of the motor is rotated about a motor axis. The rotation of the output shaft causes one of the first and second interface portions to rotate about the motor axis. The rotation of the output shaft also causes the other of the first and second interface portions to move longitudinally with respect to the motor, due to the engagement between the first and second interface portions. The longitudinal movement of said other of the first and second interface portions is converted into relative longitudinal movement between the first and second tractor body portions.

In still another aspect, the present application provides a tractor system for moving within a passage. The tractor system comprises a plurality of tractor units coupled together end-to-end, and a wireline connected to the tractor system. Each tractor unit comprises first and second body portions positioned along a longitudinal axis of the tractor unit, a gripper assembly, and a power train assembly.

In this aspect, the gripper assembly comprises a gripper motor, first and second gripper interface portions, and at least two elongated gripping elements engaged with respect to the first body portion. The gripper motor has an output shaft adapted to rotate about a gripper motor axis during activation of the gripper motor. The first gripper interface portion is oriented substantially along the gripper motor axis, and the second gripper interface portion is in engagement with the first gripper interface portion. One of the first and second gripper interface portions comprises a gripper rotating element configured to rotate about the gripper motor axis during rotation of the gripper motor's output shaft relative to a housing of the gripper motor. The other of the first and second gripper interface portions comprises a gripper extension element configured to move longitudinally with respect to the gripper motor during rotation of the gripper motor's output shaft relative to the gripper motor's housing, due to said engagement between the first and second gripper interface portions.

In this aspect, the gripping elements have a movement-limiting mode in which the gripping elements limit relative movement between the gripping elements and an inner surface of the passage, and a movement-permissive mode in which the gripping elements permit substantially free relative movement between the gripping elements and the inner surface. The gripper extension element comprises part of a gripper expansion assembly for converting longitudinal motion of the gripper extension element into movement of the gripping elements between said movement-limited mode and said movement-permissive mode of the gripping elements. The gripper assembly is configured to limit longitudinal movement of the first body portion relative to the passage when the gripping elements are in the movement-limiting mode.

In this aspect, the power train assembly comprises a power train motor, and first and second power train interface portions. The power train motor is secured with respect to the second body portion and has an output shaft configured to rotate about a power train motor axis during activation of the power train motor. The first power train interface portion extends substantially along the power train motor axis, and the second power train interface portion is in engagement with the first power train interface portion. One of the first and second power train interface portions comprises a power train rotating element coupled with respect to the output shaft of the power train motor so that the power train rotating element rotates about the power train motor axis during rotation of the power train motor's output shaft relative to a housing of the power train motor. The other of the first and second power train interface portions comprises a power train extension element configured to move longitudinally with respect to the power train motor during rotation of the power train motor's output shaft relative to the power train motor's housing, due to said engagement of the first and second power train interface portions. The power train extension element is longitudinally fixed with respect to the first body portion. The wireline is adapted to convey one or both of (1) electrical power for powering the gripper motors and power train motors of the tractor units, and (2) electronic signals for controlling the gripper motors and power train motors of the tractor units.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Limitations of Prior Wireline Tools

Although success has been achieved in the conveyance of logging tools by wireline tractors in cased holes, relatively few attempts at operations in open boreholes have been successful. One problem that is frequently experienced is that it is difficult to provide sufficient traction in open hole conditions. It is also difficult to traverse washouts (regions of larger hole size) and cave-ins (regions of smaller hole size) while still pulling or pushing a bottom hole assembly with sufficient force.

Several other problems of existing wireline tools have been experienced. For example, some tools exhibit high heat dissipation, especially in some high temperature formations, from downhole AC electric motors, which results in frequent downhole failures, especially in long deep wells. Other problems include contamination of motors with downhole fluids, attack of tool metals by downhole fluids (e.g., acids), unreliable electrical connectors, and the inability to grip the hole wall at a variety of hole diameters with one gripper assembly. Also, many existing wireline tools are unable to traverse debris such as sand located on the low side of a borehole, especially when the borehole is horizontal (which is the type of borehole in which open hole wireline tractors are normally used). Another problem is that wireline tools are typically able to move in only one directional. In open hole operations, the ability to be bidirectional is advantageous.

It is a purpose of this application to disclose a new innovative electrically powered tractor that overcomes these limitations of previous tools and tractors and delivers a highly reliable tool for conveyance of instruments and tools downhole.

Overview

Figure 1:
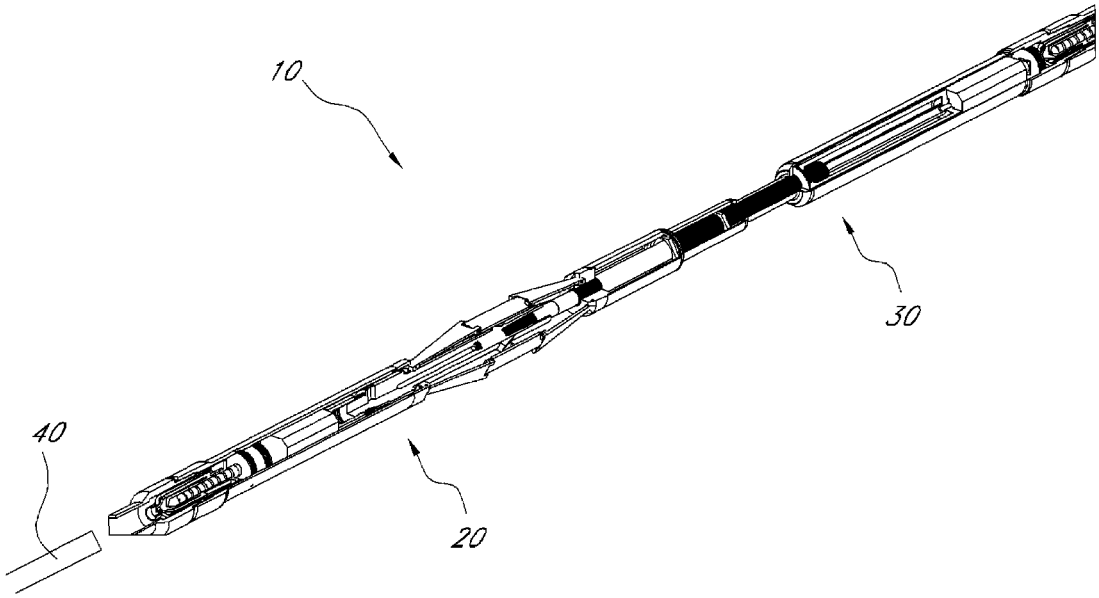
FIG. 1 is a perspective, sectional view of an embodiment of a wireline tractor.

FIG. 1 shows an electrically powered tractor or tool 10 in accordance with certain embodiments. The tractor 10 comprises an electrically powered and/or controlled gripper assembly 20, and an electrically powered and/or controlled power train assembly 30. When actuated, the gripper assembly 20 expands to grip onto the inner surface of a passage within which the tractor 10 is positioned. The gripping of the passage wall provides a point of contact against which the power train assembly 30 propels the tool 10. The power train assembly 30 produces longitudinal movement of the tractor 10 in a desired direction within the passage. As used herein, an "electric gripper assembly" refers to a gripper assembly that is electrically powered, and possibly electronically controlled. As used herein, an "electric power train assembly" refers to a power train assembly that is electrically powered, and possibly electronically controlled.

In some embodiments, electrical power and/or control signals for the assemblies 20 and 30 are conveyed via a wireline 40, which is shown disconnected from the tractor 10. It will be understood that the wireline 40 can be mechanically and electronically connected to the tractor 10 to electrically power and control the tractor. Many different sizes and types of wireline 40 may be connected to the tractor. The wireline 40 may include a single electrical conductor (e.g., a wire) or multiple conductors, with seven conductors being used in one embodiment. A wireline tractor 10 may be connected to wireline 40 of any suitable size or diameter, typically from 3/16 inch to 7/16 inch, and any practical length of wireline, typically 20,000-35,000 feet. The electrical resistance of the wireline 40 normally varies as a function of length. In one embodiment involving a multi-conductor wireline 40, the electrical resistance of the wireline is about 10 Ohm per 1000 feet of wireline length. The wireline 40 can have various voltage and current ratings. In one embodiment involving a multi-conductor wireline 40, a maximum of 1.5 A at 1000V at the ground surface is used.

The physical size of the tractor 10 is preferably scalable and may vary depending upon the application. For example, the tractor 10, when used for open hole logging, may have a collapsed diameter (as used herein, "collapsed diameter" refers to the diameter when the gripper assembly 20 is radially retracted) that ranges from 2-6 inches, with approximately 5 inches being preferred for open hole logging within holes of approximately 6-9 inches diameter. The length of the tractor 10 can also be selected based upon its intended usage. For example, if it is necessary to deploy the tractor 10 into a well with a gin pole, then the length of the tractor 10 (or a held segment thereof) is preferably less than about 20 feet, and preferably about 12-15 feet.

The illustrated tractor 10 may be used alone as an independently acting tractor. Alternatively, the illustrated tractor 10 can comprise a single unit of a multi-unit tractor system. For example, the tractor 10 can be connected to a plurality of other similar units. Thus, an electrically powered tractor system may comprise one, two, three, or more tractor units 10 as shown in FIG. 1. The number of tractor units may be selected based upon various factors, such as the availability of electrical power downhole and the pulling requirements of the tractor system. In one embodiment, each tractor unit 10 of a multi-unit tractor system includes an electric gripper assembly 20 and an electric power train assembly. In another embodiment, a tractor system comprises two electric gripper assemblies 20 and only one electric power train assembly 30. These embodiments are described in further detail below.

A wireline tractor system (which can include one or more tractor units 10) may be located at any position within a deployed tool string. For example, the tractor system can be positioned either aft or forward of a bottom hole assembly (BHA). If the tractor system is positioned forward of the BHA, then all of the tools and components of the BHA are preferably configured to convey the electrical power and/or electronic signals from the wireline 40 to the tractor system. This can be problematic if some of the tools and components have power ratings that are less than that of the tractor system. However, an advantage of positioning the tractor system forward of the BHA is that the tractor system can help centralize the BHA tools and components (e.g., logging tools) within the borehole, and can also help facilitate a smoother entry of the BHA into the borehole from the ground surface. In another embodiment, the tractor system is positioned aft of the BHA, in which case the tractor system is preferably configured to convey electrical power and/or electronic signals to the BHA tools and components (if said tools and components require electrical power and/or electronic signals from the wireline 40).

Applications for Preferred Embodiments

The electrically powered tractor systems 10 disclosed herein may be used to assist in the delivery of tools for a wide variety of downhole activities. For example, embodiments of a tractor system 10 may be used for either cased or open hole logging of all types. Embodiments may be used to convey equipment to perform side wall coring or free point detection. Embodiments may be used for carrying equipment to perform caliper surveys, finding holes in tubing, and/or running temperature and pressure surveys. Embodiments may be used in conjunction with equipment to move or shift downhole sliding sleeves on screens. Embodiments may be used to assist with freeing stuck pipe, and/or to deliver jet or chemical cutters to cut casing. Embodiments may be used to convey equipment to repair and condition tubing. Embodiments may be used to deliver tools that perform operations to control or remove sand or paraffin. Other string elements that may be connected aft or forward of embodiments of the tractor system 10 include, but are not limited to, stems, jars, knuckle joints, running or pulling tools, and/or fishing tools. Embodiments may be used to carry perforation guns to perforate casing or hole formations. Embodiments may be used to deliver or retrieve downhole equipment including nipples, packers, whip stocks, lateral entry modules, subsurface control devices, and other downhole assemblies.

Gripper Assembly

This section generally describes the components of an electric gripper assembly and its expansion and retraction. The gripper assembly is herein described in connection with certain tractor body portions positioned along a longitudinal axis of the tractor. As used herein, such a body portion need not actually intersect the tractor's longitudinal axis. For example, a body portion can be cylindrical and surround the axis without intersecting it.

Figure 2:
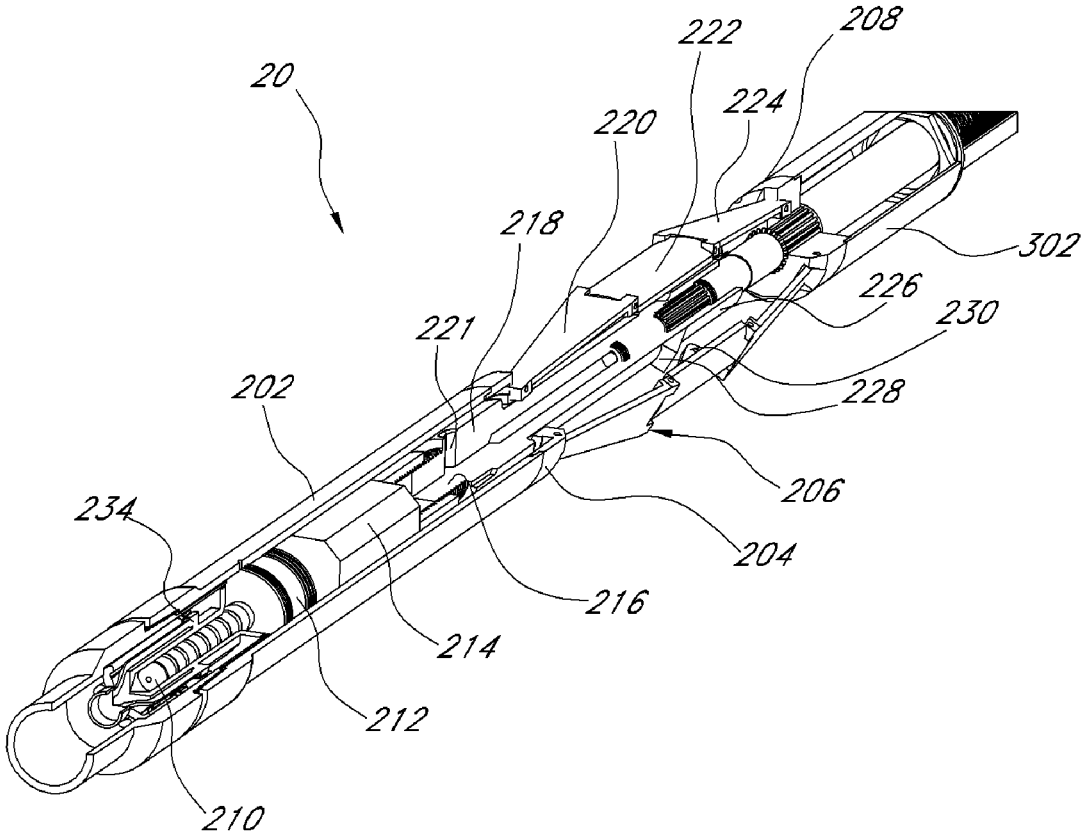
FIG. 2 is a perspective, sectional view of an embodiment of a gripper assembly employing a linkage-type passage gripping element.

FIG. 2 shows an embodiment of the gripper assembly 20 of a tractor unit 10 (FIG. 1). The illustrated gripper assembly 20 includes a gripper motor housing 202, a first toe anchor 204, a plurality of passage gripping elements or toes 206, and a second toe anchor 208. The gripper motor housing 202 houses a wireline connector 210, motor controller 212, and electric gripper motor 214. Also shown in FIG. 2 are a drive screw (or more generally an interface portion) 216 and a toe nut (or more generally an interface portion) 218 in engagement (e.g., threaded engagement) with one another. As used herein, the terms "lead screw" and "drive screw" are used interchangeably, and both may encompass different types of screws, including a ball screw. FIG. 2 also shows a conduit 221 that may contain electrical wires for conveying electrical power and electronic signals through the gripper assembly 20.

The housing of the motor 214 is preferably fixed with respect to the gripper motor housing 202. Generally, one of the drive screw 216 and the toe nut 218 can comprise a "rotating element" configured to rotate about the longitudinal axis of the tractor during activation of the gripper motor 214, and the other of the drive screw 216 and the toe nut 218 can comprise an "extension element" configured to move longitudinally with respect to the gripper motor 214 during rotation of the motor's output shaft relative to a housing of the motor, due to the threaded engagement between the drive screw and the toe nut. It should be understood that, in embodiments, the extension element does not necessarily move with respect to the motor 214 during motor activation (i.e., while the motor is powered on, but not necessarily rotating its output shaft, or while the motor's output shaft is rotating). For example, as described elsewhere herein, a clutch can decouple the gripper motor 214 from the rotating element. The rotating element can be coupled directly or indirectly with respect to an output shaft of the gripper motor 214. In the illustrated embodiment, the drive screw 216 is the rotating element, because it is coupled with respect to an output shaft of the gripper motor 214. The illustrated toe nut 218 is the extension element because it is prevented from rotating, such as by having a notch that engages an elongated spline 226. In an alternative embodiment, the toe nut 218 has an alignment pin that engages a longitudinal slot to prevent the nut 218 from rotating. It will be appreciated that alternative guidance features can alternatively be provided. Thus, the toe nut 218 moves longitudinally as the drive screw 216 rotates. In an alternative embodiment, the toe nut 218 is the rotating element, being coupled with respect to the output shaft of the gripper motor 214, and the drive screw 216 is the extension element.

The wireline connector 210 is preferably configured to mechanically and electrically connect with a wireline 40 (FIG. 1) containing one or more electrical conductors. The wireline connector 210 conveys electrical power and preferably electronic signals from the wireline 40 to the motor controller 212. The motor controller 212 may be configured to control the gripper motor 214 in accordance with the electronic signals.

The gripper assembly 20 is preferably longitudinally fixed with respect to a body portion of the tractor 10, the body portion being positioned along the longitudinal axis of the tractor. As used herein, a body portion "positioned along" the tractor's longitudinal axis may or may not intersect said axis. In the illustrated embodiment, the gripper assembly 20 is longitudinally fixed with respect to an outer torque slider housing 302. The gripper assembly 20 has a movement-limiting mode (e.g., a radially expanded position) in which it limits relative movement between the gripper assembly 20 and an inner surface of a passage within which the tractor is positioned. The gripper assembly 20 also has a movement-permissive mode (e.g., a radially retracted position) in which it permits substantially free relative movement between the gripper assembly 20 and the inner surface of the passage.

The gripper assembly 20 preferably includes two or more passage gripping elements 206, positioned at substantially equal angular intervals about the circumference of the tractor. Preferably, the ends of the passage gripping elements 206 are radially fixed with respect to a longitudinal axis of the tractor. In the illustrated embodiment, each of the passage gripping elements 206 has a first end rotatably connected (e.g., via a link pin) to the first toe anchor 204 and a second end rotatably connected (e.g., via a link pin) to the second toe anchor 208. Also in the illustrated embodiment, each passage gripping element 206 comprises an aft toe link 220, a toe nail 222, and a forward toe link 224 that collectively behave as a three-bar linkage. The toe nails 222 can include roughened surfaces that frictionally engage a cased or uncased borehole passage. Each gripping element 206 preferably has a passage engagement surface that is not part of a wheel or conveyor belt.

In a preferred embodiment, expansion and retraction of the gripper assembly 20 is produced by delivering electrical commands and power to the gripper motor 214 via the motor controller 212. The motor controller 212 can operate the gripper motor 214 in a specified pattern. This pattern may be programmed into electrical components within the tractor 10. Alternatively, the commands may be sent from the surface via a computer running appropriate customized software or commercially available software such as LabView by National Instruments, daqview by IOTech, or Warrior by Scientific Data Systems. Alternatively, proprietary software may be used to control the tractor. Note that the electrical conduit within the tractor 10 is not shown in FIG. 2.

In a preferred embodiment, the gripper motor 214 responds to these electronic commands by rotating the drive screw 216, which drives the toe nut 218 longitudinally. The toe nut 218 can comprise part of a gripper expansion assembly for converting longitudinal motion of the toe nut 218 into movement of the gripper assembly 20, and in particular the passage gripping elements 206, between the aforementioned expanded and retracted positions. In preferred embodiments, the gripper expansion assembly is configured to push each gripping element 206 radially outward at a location of the gripping element that is between opposing ends of the gripping element, in order to move the gripping element 206 to its expanded position. In one embodiment, that location of each gripping element 206 is at an approximate center of each gripping element. Different embodiments of gripper expansion assemblies are discussed below.

Figure 2A:
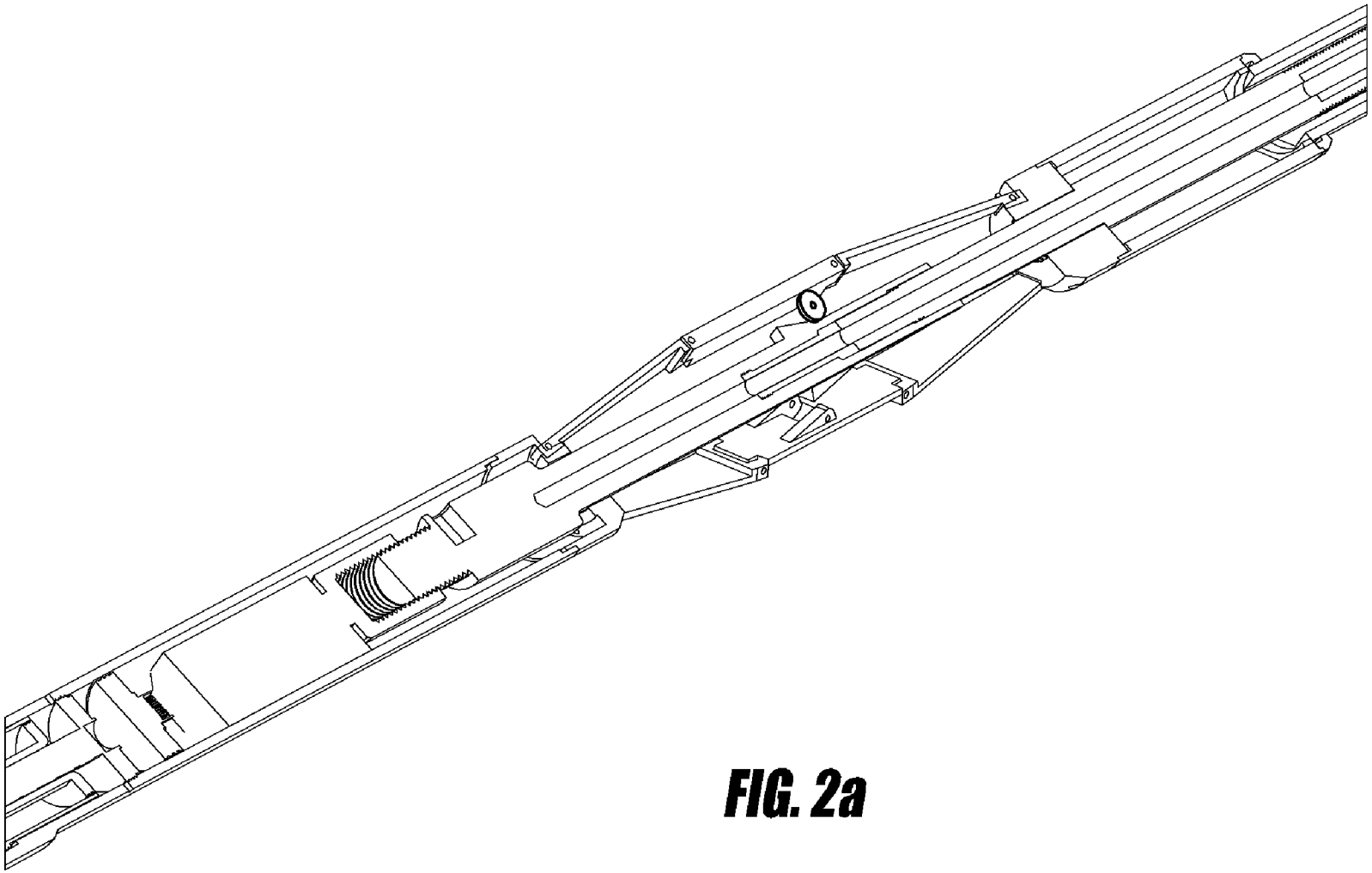
FIG. 2*a* is a perspective, sectional view of an embodiment of a retracted gripper assembly employing a single flexible beam as a passage gripping element.
Figure 2B:
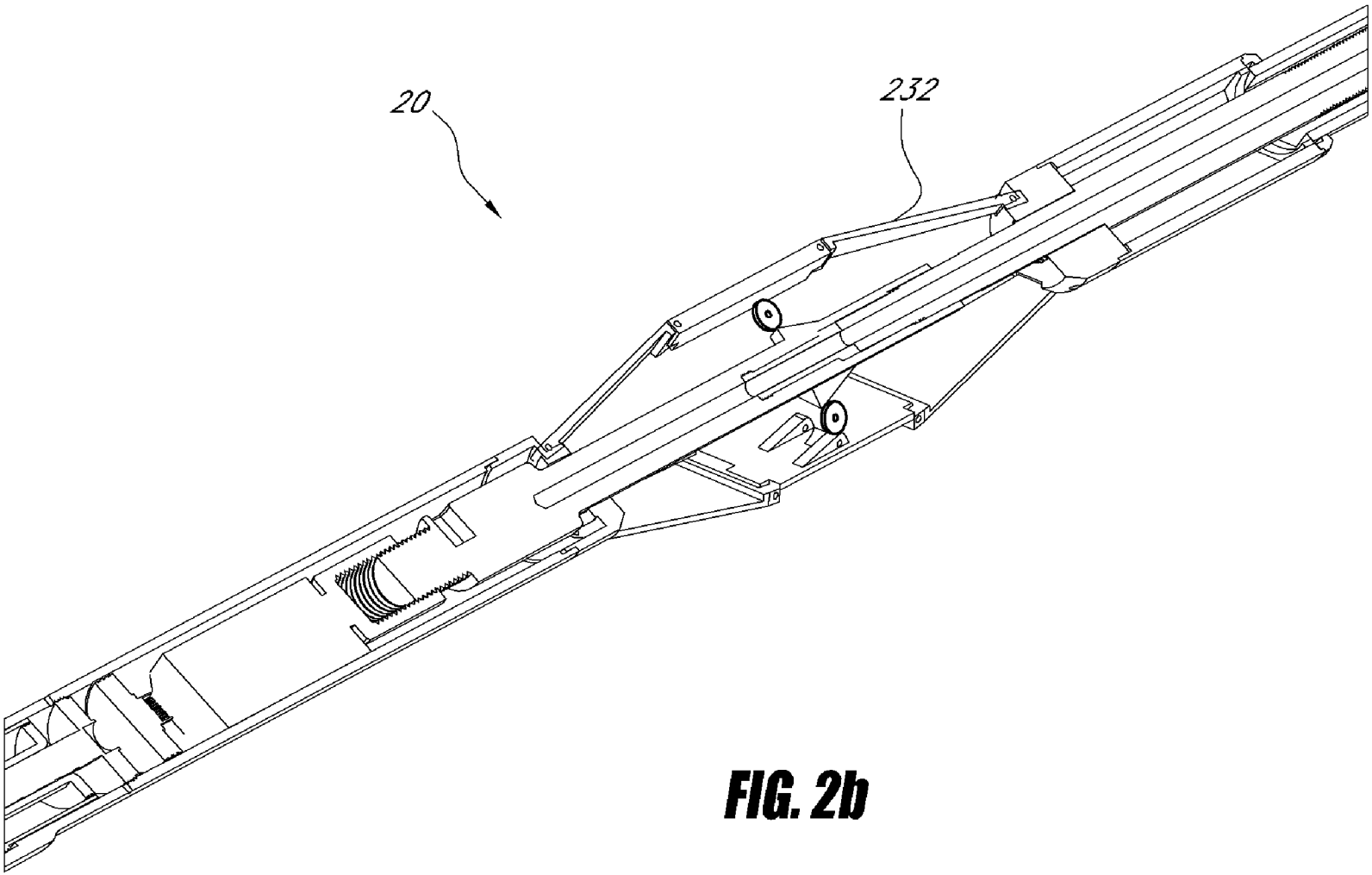
FIG. 2*b* is a perspective, sectional view of the embodiment of FIG. 2*b*, wherein the gripper assembly is expanded.

In an alternative embodiment, shown in FIG. 2*a*, each passage gripping element 206 comprises a single flexible beam or toe 232 having opposing ends that are each fixed radially with respect to the tractor. For example, the beam 232 can have a first end rotatably connected (e.g., via a link pin) to the first toe anchor 204 and a second end rotatably connected (e.g., via a link pin) to the second toe anchor 208. The beam 232 is flexed when the gripper assembly 20 occupies its expanded position. This illustrates the interchangeability of different types of gripping elements 206 into the electric gripper assembly 20. FIG. 2*b* shows the flexible beams 232 in their expanded positions, in accordance with one embodiment. The use of flexible beams 232 produces a predictable load that can be tuned (of such a magnitude) to the frictional resistance of the lead screw, which can contribute to the failsafe operation of the tractor.

With continued reference to FIG. 2, in certain embodiments the longitudinal distance between the first and second toe anchors 204 and 208 is fixed. In such embodiments, the passage-gripping elements 206 can be coupled to the toe anchors 204 and 208 via pins engaged within slots. Such slots can be located in the toe anchors 204 and 208, or alternatively in the gripping elements 206, or in both. The slots may accommodate the radial expansion of the gripping elements 206. In other embodiments, one of the toe anchors 204 and 208 can be configured to move longitudinally toward and away from one another to accommodate the radial expansion of the passage gripping elements 206. For example, the toe anchors 204 and 208 can be provided on an elongated mandrel, as disclosed in several of the patents incorporated herein by reference, such as U.S. Pat. No. 6,464,003 to Bloom et al.

One advantage of a passage gripping element 206 comprising a single flexible beam 232 as in FIG. 2*a* is that it is inherently failsafe, meaning that it has a proclivity to straighten itself when power to the gripper assembly 20 is terminated or interrupted. As used herein, the term "failsafe" refers to the quality of automatically retracting from the borehole surface during a power loss, which helps to prevent the tractor from getting stuck and being difficult to remove from the borehole. When the expansion force is terminated, the flexible beams 232 tend to straighten and move away from the borehole wall, which thereby collapses the gripper assembly when electrical power is interrupted. When retracting, the beams 232 can urge the drive screw 216 to rotate in reverse (i.e., the direction of rotation opposite that which cases the gripper assembly 20 to expand), if the friction associated with drive screw rotation is low enough. Examples of gripper assemblies employing flexible beams are disclosed in U.S. Pat. No. 6,464,003 to Bloom et al.

On the other hand, an advantage of a linkage-type passage gripping element 206, as shown in FIG. 2, is that it can achieve greater radial expansion for any given length in its retracted condition. This can be significant when large expansions are required in usage. An example of a linkage-type gripper assembly is disclosed in U.S. Pat. No. 7,392,859 to Mock et al.

Regardless of whether a linkage-type gripping element 206 or a flexible beam 232 is used, the ends of the gripping element can have bifurcated terminations that assist in distributing load. This increases both maximum tensile capacity and fatigue endurance limits. Preferably both ends of each gripping element 206 are bifurcated, particularly for tractors that are bidirectional. Examples of gripping toes with bifurcated ends are shown and described in U.S. Pat. No. 7,624,808 to Mock.

Various types of gripper motors 214 may be provided, including alternating current (AC) or direct current (DC) motors. A DC motor may be either brush-type or brushless. The motor 214 can be three-phase AC synchronous, a stepper motor, or a reluctance motor. In a preferred embodiment, the gripper motor 214 is a DC brushless motor. The DC brushless motor is preferred over brush motors because it is more compatible with a 7-conductor wireline 40, requires the fewest number of power conductors (requires two to four conductors, depending upon paralleling), provides higher efficiency and reliability, emits less electrical noise, and has longer operational life. A DC brushless motor also reduces or eliminates sparking, lowers electromagnetic interference (with electronic control signals), and has higher maximum power output. Further, there currently appears to be an industry preference for DC motors, primarily from a few specialty suppliers. On the other hand, a limitation of using a DC brushless motor is that it can require extensive downhole electronics to coordinate motor motion and commutation duties. Also, DC motors can require downhole microprocessors that have poor mean-time-to-failure in elevated temperature environments. DC motors with permanent magnets become increasingly sensitive to de-magnetization at elevated temperatures.

Alternatively, the gripper motor 214 can be an AC motor. AC motors require less downhole electronics, which are susceptible to being affected by heat. Moreover, in some configurations, all downhole electronics may be eliminated with a special connector that acts as both rotary joint and motor select. Certain types of AC motors are more reliable than some DC motors. Also, AC motors are compatible with inexpensive, surface-deployable, motor control electronics that are readily available "off-the-shelf" AC motors provide good torque, low vibration, and speed control, as well as only stator winding. Downsides of AC motors include the need for more conductors, and the fact that the oil industry has a history of problems with AC motors.

Several suppliers of motors may supply off-the-shelf or specially made motors and controllers. Motor Appliance Corporation supplies AC induction motors that operate at temperatures up to 350° F. SI Montevideo Technology has built DC brushless servo and induction motors that operate at elevated temperatures. Esterline Corporation and Artus Corporation provide motors for borehole applications. These and other suppliers may provide motors and controllers for the electrically powered tractors 10 disclosed herein. In one embodiment, the gripper motor 214 delivers about 2.2 horsepower.

The gripper motor 214 may include a clutch system to allow failsafe disengagement of the tractor 10 from the borehole wall, particularly in the event of a power loss. Various types of mechanical and electrically controlled clutch systems may be incorporated or attached with respect to the gripper motor 214. The clutch preferably causes disengagement of the gripper motor 214 with respect to the rotating element (either the drive screw 216 or the toe nut 218) coupled thereto. In particular, the clutch preferably has an actuated position for coupling the gripper motor's output shaft with respect to the rotating element, and a de-actuated position for decoupling the gripper motor's output shaft with respect to the rotating element. As noted above, in the illustrated embodiment the drive screw 216 is coupled with respect to the output shaft of the gripper motor 214. When the clutch is disengaged, the drive screw 216 can rotate without having to overcome the internal resistance of the gripper motor 214. This underscores the advantages of using flexible beams 232 in combination with the clutch, because the beams can back drive the drive screw 216 as mentioned above. This allows the passage gripping elements 206 to collapse either at the time of power loss or during the retrieval of the tractor 10 (e.g., by pulling the wireline 40 out of the borehole), or both.

In one embodiment, the clutch is controlled by a solenoid that moves the clutch between its actuated and de-actuated positions. Preferably, the solenoid moves the clutch to its de-actuated position in the event of a loss of electrical power to the gripper motor 214. When power is interrupted to the solenoid, the clutch disengages from the gripper motor 214 and allows the gripper assembly 20 to retract. When a continuous beam 232 is used, the force from the relaxation of the beam may be sufficient to failsafe collapse the gripper assembly 20.

Figure 2C:
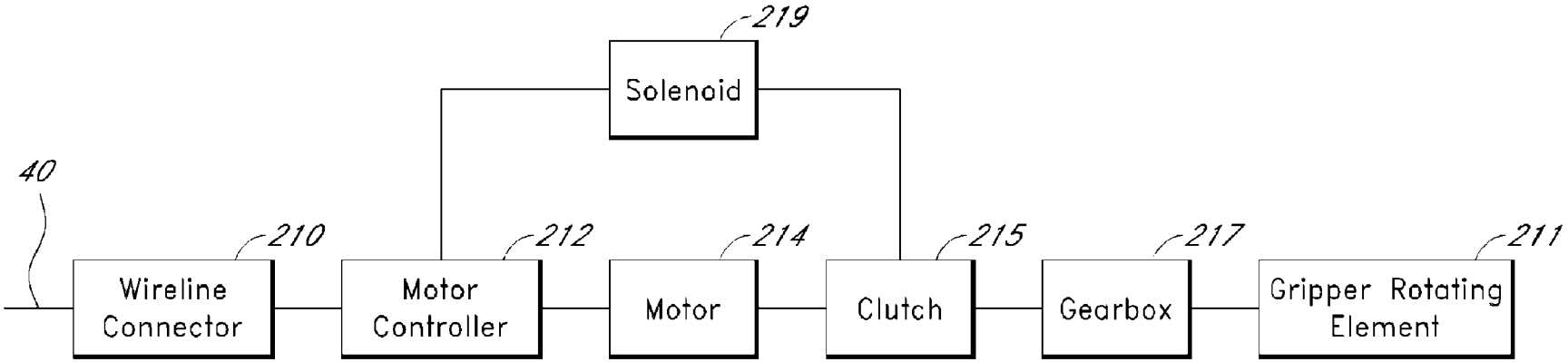
FIG. 2*c* is a schematic illustration of an embodiment of a clutch system for decoupling a motor from a rotating element.

FIG. 2*c* schematically illustrates an assembly involving a clutch system and gearbox in accordance with one embodiment. As explained above, the wireline 40 connects to the wireline connector 210. Electrical power and/or signals are conveyed to the motor controller 212 and onto the motor 214. The motor 214 drives a gripper rotating element 211 (such as the drive screw 216) as described above. In this embodiment, a clutch 215 and gearbox 217 are interposed between the motor 214 and the gripper rotating element 211. A solenoid 219 is connected to the clutch 215. In the event of an interruption in electrical power to the motor 214, the solenoid 219 is preferably configured to cause the clutch 215 to decouple the motor 214 with respect to the gripper rotating element 211, such as by moving the clutch to a de-actuated position. FIG. 2*a* shows a location 223 where one or more of the motor controller 212, motor 214, clutch 215, gearbox 217, and solenoid 219 may be located.

In some embodiments, a mechanical locking device is provided, which locks the gripper assembly 20 into its expanded position. Preferably, the locking device is configured to allow the gripper assembly 20 to retract in the event of a loss of electrical power, to achieve the aforementioned failsafe functionality. In one embodiment, the mechanical locking device is held into a locking position (in which the locking device maintains the gripper assembly 20 in its expanded position) by an electronic element, such as the aforementioned solenoid. In the event of electrical power loss, the solenoid circuit is opened and the gripper closes. If flexible beams 232 are used as the passage-gripping elements 206, the beams themselves can provide the retraction force, due to their proclivity to straighten. Of course, other elements can provide the retraction force, such as springs. In one embodiment, the proclivity of the passage-gripping elements to retract can be useful during the normal walking process of the tractor 10, providing more energy to the power train assembly 30 and its longitudinal movement.

The gripper motor 214 may include a gearbox to allow a more efficient use of power and to assist in gripping the borehole wall. In particular, a gear-reduction assembly interposed between the rotating element and the output shaft of the gripper motor 214 can comprise one or more gears that cause the output shaft and the rotating element to rotate at different speeds. The gearbox allows better compatibility of electric motor speed and torque to the other parts of the assembly, thus reducing motor energy consumption and minimizing heat. A clutch may be provided for disengaging the passage gripping elements 206 from the motor/gearbox combination, so that the gripping elements can retract without being hindered by the gripper motor 214 or the gears, or at least without being hindered by the motor 214. The clutch may be mechanical, electrical, or hydraulic. The gear reduction ratio can be any suitable number, giving due consideration to the tractor size and pulling load. In one embodiment, the gear reduction ratio is about 10:1, but it will be understood that the gear reduction ratio can fall anywhere within a large range.

The motor controller 212 may include several controllers. For example, the motor controller 212 can include controller components for the gripper motor 214, the power train motor 310 (FIG. 3), and for like controllers and/or motors of additional tractor units 10. Regarding the latter, the controllers 212 can have a so-called master-slave relationship such that a master motor controller 212 of a master tractor unit 10 may control controllers 212 of one or more slave tractor units 10. Alternatively, the aft tractor unit 10 can have a motor controller 212 that directly controls all of the motors (and optionally other components) of the other tractor units 10, wherein such other tractor units do not have their own controllers 212.

The gripper assembly 20 is preferably lightweight and has a high fatigue life. When operating a tractor, the objective is ordinarily to maximize the tractor's pulling/pushing power. This objective is furthered by using lightweight components. Thus, the components of the gripper assembly 20 can be made from lightweight materials. Also, the gripper assembly 20 can have a lightweight design. For example, the passage-gripping elements 206 can be formed from composite materials, which have high tensile strength, long fatigue life, and light weight. Other parts of the gripper assembly may also be optimized to reduce weight.

In one embodiment, the passage-gripping elements 206 (whether multi-bar linkages or flexible beams 232), the toe anchors 204 and 208, the gripper motor housing 202, and elements of the gripper expansion assembly (e.g., lifting mechanism, operating sleeve) may be formed of copper beryllium alloys. Alternatively, titanium or other high strength flexible metals and composites may be used, particularly if flexibility and high strength are preferred qualities (such as for the passage-gripping elements 206). In another alternative, the toe nut and the gripper expansion assembly (different embodiments of which are described below) and the gripper motor housing 202 may be formed from Inconel, various stainless steels, or other materials. These materials are preferred candidates because of their resistance to acid, drilling mud, salt, petroleum products, and other down hole fluids. It is also possible that components of the tractor 10 be made from cast metals and/or organic compounds, including plastics and various types of composites of organic and inorganic materials.

Power Train Assembly

Figure 3:
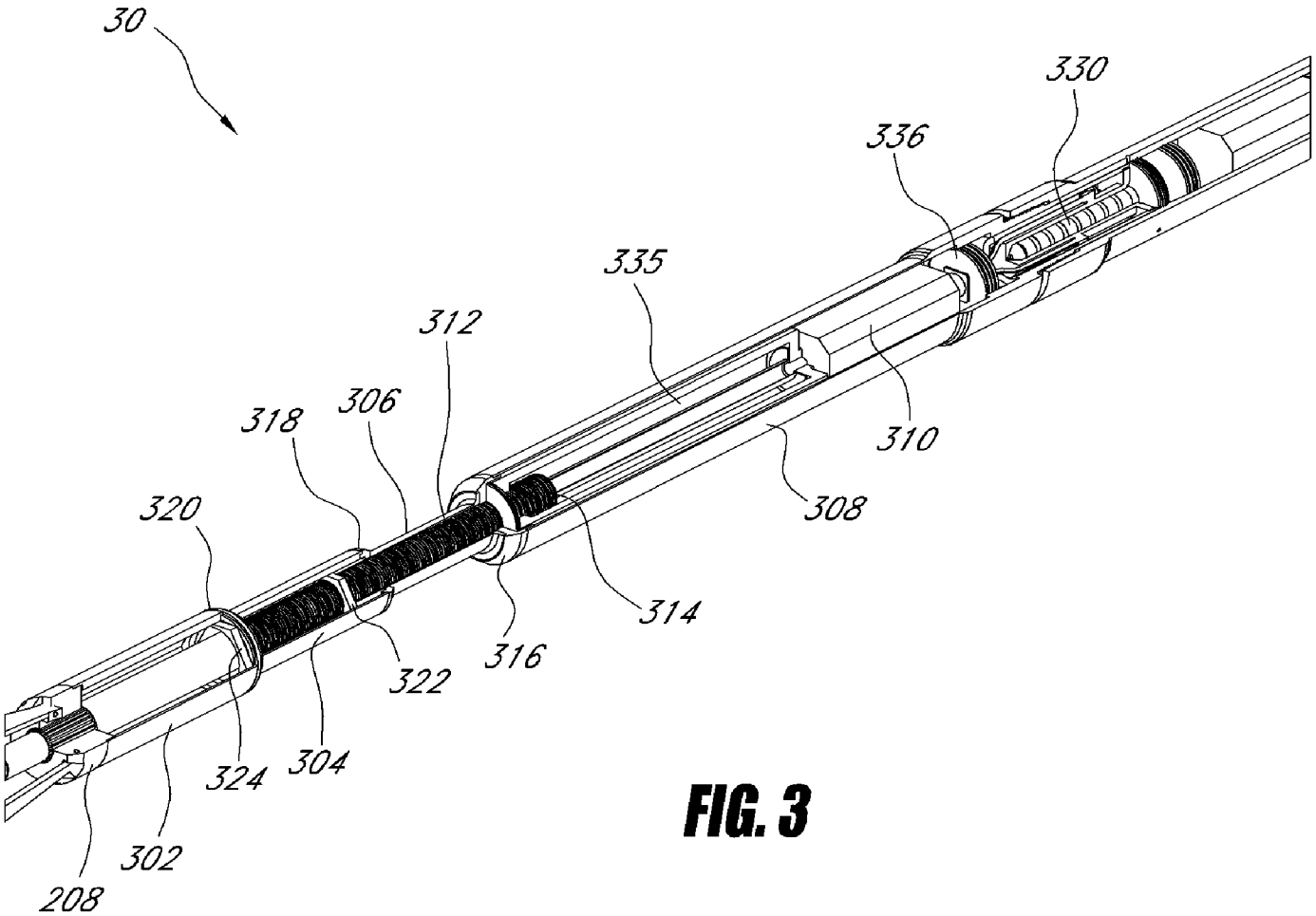
FIG. 3 is a perspective, sectional view of an embodiment of a power train assembly of a tractor.

With reference to the embodiments illustrated by FIGS. 1 and 3, the power train assembly 30 produces the longitudinal motion of the tractor 10. In the illustrated embodiment, the power train assembly 30 includes an outer torque slider housing 302, an intermediate torque slider housing 304, an inner torque slider housing 306, and a stroke tube 308. The stroke tube 22 contains an electric power train motor 310, a drive nut 314, and a lead screw (or, more generally, interface portion) 312 in engagement (e.g., threaded engagement) with the drive nut (or, more generally, interface portion) 314.

The housing of the power train motor 310 is preferably fixed with respect to a body portion of the tractor. In the illustrated embodiment, the housing of the power train motor 310 is fixed with respect to the stroke tube 308. The motor 310 preferably has an output shaft configured to rotate about a motor axis that is substantially collinear with or parallel to the tractor's longitudinal axis during activation of the motor 310. The illustrated lead screw 312 extends substantially along the motor axis. The lead screw 312 is preferably fixed with respect to a body portion of the tractor, such as the outer torque slider housing 302 or the second toe anchor 108.

Figure 3A:
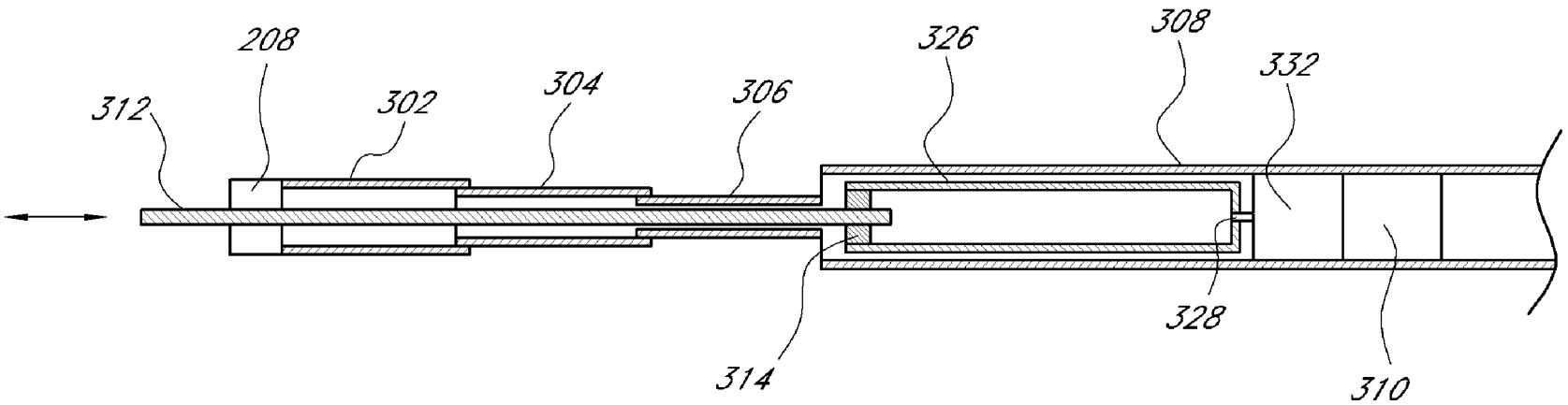
FIG. 3*a* is a sectional view of an embodiment of a power train assembly.

FIG. 3*a* shows an embodiment of a coupling between the power train motor 310 and the drive nut 314. The drive nut 314 is preferably coupled with respect to the output shaft 328 of the motor 310 so that the drive nut 314 rotates about the motor axis during activation of the motor 310. Preferably, a nut driver assembly couples the output shaft 328 to the drive nut 314. In the illustrated embodiment, the nut driver assembly comprises a drive tube 326 having a first end coupled to the output shaft 328 of the motor 310, and a second end coupled to the drive nut 314. The lead screw 312 is preferably prevented from rotating, such as by being fixed to the second toe anchor 108 or another element of the tractor 10. In certain embodiments, the lead screw 312 has a feature that engages a guidance feature of the tractor 10 to prevent rotational motion of the lead screw 312. For example, the lead screw can have an elongated spline that engages a notch in an element of the tractor 10, or an elongated groove that engages a protrusion of the tractor 10. The guidance feature can be located in, for example, one of the torque slider housings 302, 304, and 306. In preferred embodiments, the guidance feature is on an inner surface of the outer torque slider housing 302.

The rotation of the drive nut 314 causes the lead screw 312 to move longitudinally with respect to the motor 310 and the stroke tube 308 due to the threaded engagement between the drive nut 314 and lead screw 312. This in turn produces relative longitudinal displacement between the stroke tube 308 and the outer torque slider housing 302. Thus, the longitudinal motion of the tractor 10 is produced by the rotational output of the power train motor 310, which moves the lead screw 312 longitudinally. The lead screw 312 is preferably attached with respect to the gripper assembly 20. With the gripper assembly 20 expanded and gripping the hole wall, the power train assembly 30 expands or contracts to produce longitudinal movement of the tractor 10 within the well. In other words, the longitudinal movement of the tractor 10 is preferably produced by expansion and retraction of the slider housings (302, 304, and 306) relative to the expanded gripper assembly 20.

In the illustrated embodiment, the gripper assembly 20 is mechanically attached to the power train assembly 30 by the second toe anchor 208, and the second toe anchor 208 is attached to the outer torque slider housing 302. The outer torque slider housing 302 preferably allows the intermediate torque slider housing 304 to move longitudinally within the outer torque slider housing 302. The intermediate torque slider housing 304 preferably allows the inner torque slider housing 306 to move within the intermediate torque slider housing 304. The inner torque slider housing 306 is preferably fixed with respect to the stroke tube 308. Thus, the housings 302, 304, and 306 are nested together to expand and contract in telescoping fashion. It will be appreciated that any number of such telescoping housings can be provided to achieve a desired tractor movement stroke (distance traveled during one complete movement cycle).

The lead screw 312 preferably extends from the stroke tube 308 through interiors of the inner torque slider housing 306, the intermediate torque slider housing 304, and the outer torque slider housing 302. The lead screw 312 preferably extends to the second toe anchor 208, and may have either a fixed or splined connection with the second toe anchor 208. The outer torque slider housing 302 is preferably capped with an outer torque cap 320. Similarly, the intermediate torque housing 304 is preferably capped with an intermediate torque cap 318. The outer torque cap 320 has an inner dimension (circular in the illustrated embodiment) that preferably closely receives the intermediate torque slider housing 304, and the intermediate torque cap 318 has an inner dimension (also circular in the illustrated embodiment) that preferably closely receives the inner torque slider housing 306. Hence, each pair of adjacent torque slider housings produces a telescoping motion that is preferably relatively smooth and resistant to hang ups or downhole variations in hole size.

Referring to FIGS. 3 and 3*a*, the drive tube 326 rotates along with the output shaft 328 of the motor 310. The stroke tube 308 and drive tube 326 are preferably sufficiently long to accommodate the desired stroke of the power train assembly 30. Additional bearings and support may be provided within the stroke tube 308, in order to maintain the stroke tube 308 and drive tube 326 in a substantially concentric relationship. The drive nut 314 is preferably housed within the space defined by the stroke tube 308, stroke cap 316, and motor 310. An electrical wet stab connector 330 may be provided forward of the power train motor 310 for connection to downhole components, such as another tractor unit 10, or another gripper assembly. FIG. 3 also shows an electrical conduit 335 for conveying electrical wires through the power train assembly 30.

As noted above, the housing of the power train motor 310 is preferably rigidly fixed with respect to the stroke tube 308. Thus, when the output shaft of the motor 310 rotates, the nut driver assembly and drive nut 314 rotate as well. If the lead screw 312 is fixed with respect to the second toe anchor 208, the longitudinal movement of the lead screw 312 produces longitudinal expansion and retraction of the slider housings 302, 304, and 306 with respect to one another. If the lead screw 312 has a splined engagement with the second toe anchor 208, the lead screw 312 can be provided with one or two stops that bear against and move the second toe anchor 208 to expand or retract the slider housings 302, 304, and 306 with respect to one another.

While the illustrated embodiment includes a drive nut 314 that is coupled with respect to the output shaft of the power train motor 310, and a lead screw 312 that moves longitudinally with respect to the motor 310, these characteristics can be reversed. In other words, in certain embodiments the lead screw 312 is coupled with respect to the output shaft of the power train motor 310, and the drive nut 314 moves longitudinally along the lead screw 312. In such an embodiment, the drive nut 314 is preferably elongated (or connected to an elongated structure) to cause the expansion and retraction of the slider housings 302, 304, and 306 in a manner as described above with respect to the lead screw 312.

Thus, in general, one of the lead screw 312 and drive nut 314 comprises a rotating element coupled with respect to the output shaft of the motor 310 so that the rotating element rotates about the output shaft's axis during rotation of the output shaft relative to the housing of the motor 310. Also, in general, the other of the lead screw 312 and drive nut 314 comprises an extension element configured to move longitudinally with respect to the motor 310 during rotation of the motor's output shaft relative to the housing of the motor 310, due to the engagement of the lead screw 312 and drive nut 314. The extension element may be longitudinally fixed with respect to the gripper assembly.

As described above in connection with the gripper motor 214 (FIG. 2), it will be appreciated that a gear reduction assembly or gearbox 332 (FIG. 3*a*) can be provided between the power train motor 310 and the drive nut 314, so that they do not rotate at the same speed. The gearbox 332 can result in a more efficient use of power for moving the tractor 10. The gearbox 332 allows better compatibility of electric motor speed and torque to the other parts of the assembly, thus reducing motor energy consumption and minimizing heat. The gear reduction ratio can be any suitable number, giving due consideration to the tractor size and pulling load.

The power train assembly 30 is preferably configured so that the housings 302, 304, and 306 are prevented from rotating with respect to one another. In one embodiment, a hex nut 322 is fixed to an end of the inner torque slider housing 306, and a hex nut 324 is fixed to an end of the intermediate torque slider housing 304. In this embodiment, the outer housing 302 contains the hex nut 324, and the intermediate torque slider housing 304 contains the hex nut 322. The hex nut 324 is preferably larger than an opening of the outer torque cap 320, which prevents disengagement of the housings 302 and 304. Similarly, the hex nut 322 is preferably larger than an opening of the intermediate torque cap 318, which prevents disengagement of the housings 304 and 306. In this embodiment, the inner dimension of at least a forward portion of the housing 302 is preferably hexagonal and closely receives the hex nut 324 in a manner that allows the hex nut 324 to move longitudinally within the housing 302 without rotating within the housing 302. Similarly, the inner dimension of at least a forward portion of the housing 304 is preferably hexagonal and closely receives the hex nut 322 in a manner that allows the hex nut 322 to move longitudinally within the housing 304 without rotating within the housing 304. Thus, the hex nuts 322 and 324 prevent relative rotation between the housings 302, 304, and 306 about the longitudinal axis of the power train assembly. This facilitates the transmission of torque therethrough.

It will be appreciated that the nuts 322 and 324, and the complementary inner dimensions of the housings 304 and 302 can have shapes (e.g., polygonal or even curved shapes) other than hexagonal shapes. In general, the power train assembly 30 is preferably configured so that the housings 302, 304, and 306 are prevented from rotating with respect to one another. Skilled artisans will understand that other means of accomplishing this goal are possible, and are within the scope of this application.

As noted above, the lead screw 312 can be equipped with a feature (e.g., a spline that engages a tractor groove, or a groove that engages a tractor spline) that causes the transmission of torque from the power train motor 310 to the gripper assembly 20 and facilitates longitudinal (non-rotational) movement of the lead screw 312. The hexagonally shaped components described below can also be used to transmit reactive torque from the motor 310 to the gripper assembly 20. However, shapes other than hexagonal may alternatively be used.

In one embodiment the use of concentric (or eccentric) telescoping housings 302, 304, and 306 allows the power train assembly 30 to expand or contract, thus providing the abilities to move downhole and to pull or push a payload (such as a wireline 40, bottom hole assembly, or other instrument package).

In one embodiment, the inner torque slider housing 306 is hollow and provides a conduit for electrical cabling for power and signals to run from the gripper assembly 20 to the power train assembly 30, and possibly to other tractor units, wireline assemblies, or downhole instruments and tools.

The motor types and suppliers discussed above in connection with the gripper motor 214 are also applicable for the power train motor 310. In one embodiment, the power train motor 310 delivers about 1.6 horsepower.

Tractor Movement and Control

A tractor system can include surface equipment and downhole equipment connected by a wireline 40. Electrical power and electronic command signals can be sent from the surface equipment to the tractor 10 via the wireline 40. As described elsewhere herein, the surface equipment can include a computer having any one or more of various types of commercial or customized software for assisting in controlling the tractor 10. Electronic commands sent from the surface equipment can include starting, stopping, and reversing direction.

Prior to propelling itself longitudinally within a borehole, the tractor unit 10 preferably expands its gripper assembly 20. The motor controller 212 can send an electronic signal to the gripper motor 214 to rotate the drive screw 216 in a direction that expands the gripper expansion assembly. The toe nut 218 moves longitudinally along the drive screw 216, causing the gripper expansion assembly to radially expand the passage-gripping elements 206. Examples of gripper expansion assemblies are disclosed below. In one embodiment, when the gripper assembly 20 begins expanding, the output torque of the gripper motor 214 is held below a certain threshold, until the passage-gripping elements 206 engage the borehole wall. Prior to the gripper assembly 20 engaging the borehole wall, the motor rotation typically will not cause the tractor unit 10 to rotate in reverse, due to the frictional resistance of the borehole, which is usually in contact with some portion of the tractor system, wireline 40, and/or bottom hole assembly. Alternatively, this potential reverse-spin of the tractor unit 10 can be addressed by a swivel-like feature within the wireline connector 210. In one embodiment, a swivel connection has multiple electrical contacts in one component of the connection and contact rings (also referred to as slip rings) located within and along the axis of a second component of the connection. Then, as the components rotate with respect to one another, the contact rings and the electrical contacts form a continuous electrical connection.

The tractor 10 can conduct the following process when walking downhole (referred to herein as a power stroke). With the gripper assembly 20 in its expanded position, and the torque slider housings 302, 304, and 306 in their compressed position, the power train motor 310 can be given an electronic command to rotate. The command can come from the motor controller 212 or from a separate motor controller associated with the power train motor 310. In the latter alternative, the separate motor controller can receive the command from the motor controller 212. The power train motor 310 rotates the drive nut 314, which in turn produces longitudinal movement of the lead screw 312 uphole, away from the motor 310, as described above. The second toe anchor 208 is connected to the forward toe link 224 (FIG. 2) of a linkage that includes the aft toe link 220 and toe nail 222, or alternatively to the forward end of a single beam 232 (FIG. 2*a*). The longitudinal movement of the lead screw 312 expands the slider housings 302, 304, and 306. In certain embodiments, the longitudinal movement of the lead screw 312 drives first the intermediate torque cap 318, and subsequently the outer torque cap 320 to move longitudinally down the hole. Thus, the rotation of the drive nut 314 causes the stroke tube 308 (and other components connected thereto) to move in a downhole direction, along with the payload of the tractor unit.

It will be appreciated that the output torque provided by the power train motor 310 is transmitted into the borehole formation by the passage-gripping elements 206. The power train motor 310 is preferably rotationally fixed with respect to the gripping elements 206 when the elements 206 are gripping the hole wall.

A reset stroke will be readily understood from the above. In particular, a reset stroke can be conducted in which the position of the stroke tube 308 is fixed relative to the borehole by a different gripper assembly than assembly 20 (FIG. 2). With the torque slider housings 302, 304, and 306 in their expanded position, the gripper assembly 20 retracts. Then, motor controller 212 (or another controller) instructs the power train motor 310 to rotate in an opposite direction. This causes the lead screw 312 to move downhole toward the motor 310. The lead screw 312 pulls the gripper assembly 20 downhole, and the housings 302, 304, and 306 contract. It will be appreciated that when the power train assembly 30 executes a reset stroke, the output torque of the motor 310 is transmitted into the other gripper assembly that is engaging the borehole wall, which may be a gripper assembly of an adjacent tractor unit 10 (see discussion below concerning multi-unit tractor systems).

Desirably, the direction of rotation of both the gripper motor 214 and the power train motor 310 is controlled by the motor controller 212. Therefore, both the power stroke and the reset stroke can be completely controlled. In addition, in embodiments employing multiple tractor units 10, a master motor controller 212 can be programmed to selectively alter the sequence of operation of the various gripper motors 214 and power train motors 310 to allow the tractor system to be bidirectional, i.e., to be able to move both downhole and uphole.

Power Delivery and Related Concerns

In some embodiments, electrical power and control for the tractor 10 is self-contained. For example, the tractor 10 may contain a battery pack to supply electricity to the motors. Also, a programmable controller may be incorporated in electronic subsystems that may include EPROMs or Programmable Logic Devices.

In other embodiments, the tractor system operates on power delivered from the ground surface. A wireline 40 can be provided to deliver electrical power and/or electronic control signals to the motors. The power may be transformed into a convenient voltage and current operating condition. For example, electrical current from the surface may be up to 1000 volts and 1.5 amps. In general, it is preferable to deliver electricity long distances downhole with high voltages, as delivered power is a function of the square of the voltage and inversely proportional to the resistance. However, depending upon the type of motors used, it may be convenient to convert the electricity into a lower voltage and higher current to facilitate motor operations. For these designs, a down voltage converter sub (not shown) may be incorporated into the bottom hole assembly. Alternatively, for some applications, it may be convenient to incorporate the voltage conversion equipment into the tractor 10 instead of using a standalone voltage converter sub.

In the illustrated embodiment, electrical power is delivered via the wireline 40 from the ground surface, through the wireline connector 210, and via internal electrical wires or cables to the motor controller 212. As noted above, the motor controller 212 preferably controls the gripper motor 214, and can also control other motors of the tractor system. In certain embodiments, the wireline connector 210 includes additional electrical contacts for the delivery of power to the power train motor 310 (FIG. 3) and to additional tractor units 10. For example, additional leads can be incorporated to deliver electrical power to one, two, or more additional gripper motors 214 and power train motors 310 of a multi-unit tractor system.

It will be understood that the amount of electrical power available at the tractor 10 greatly affects the tractor's performance. It will also be understood that the amount of power depends upon the depth of the tractor 10, as well as the local temperature at that depth. Some down hole environments may have temperatures up to 300° F. Also, the motors of a tractor 10 can dissipate considerable heat during operation. For these reasons, special considerations may be made to control heat within the tractor 10.

For example, the motors, gearboxes, and lead screws of the gripper assembly 20 and power train assembly 30 can be enclosed in pressure-compensated oil chambers. The oil can be selected to have an optimum dielectric constant, thermal conductivity, and lubricity. Further, the wall thickness of the housings for the motors can be designed to be as thin as possible (without unduly compromising strength), so as to maximize heat transfer from the motors through the oil and the housing walls to the external environment (which may be advantageous in colder environments). Externally, features such as fins may be incorporated into the tractor 10, for improved heat dissipation.

The electronics of the tractor 10 can be designed to allow operation at temperatures up to 300° F. It is well known that elevated temperatures act to reduce operational life of electronics. The electronics can be tested and burned in for a selected time to eliminate initial burnout of electrical components. In addition, the electrical parts are preferably selected or manufactured to specifications to survive prolonged heat exposure.

In seeking to provide adequate electrical power downhole through the wireline 40, energy transmission losses and surface safety requirements should be considered. Safety requirements for personnel at the ground surface (e.g., tractor operation personnel) typically limit the voltage at the surface to less than 1000 volts. Electrical energy delivered at higher voltages (for example, up to 1500 volts) and lower current results in less energy transmission losses and more power delivered to the tractor 10, which can be important at greater borehole depths. Thus, the tractor 10 preferably complies with safety limitations while maximizing energy to the tool. Also, direct current (DC) power can be used to maximize the amount of power for an operating peak voltage to the tractor 10.

The current-carrying capacity of the wireline 40 can be maximized by using a wireline with a greater number of electrical conductors. The current-carrying capacity is also increased by increasing the diameters of the conductor wires in the wireline 40, and also by selecting more conductive conductor metals. In some wireline systems, as a general rule, approximately half of the energy input into the wireline 40 at the ground surface is lost as heat into the well bore. Thus, energy loss in the wireline 40 is the largest source of energy dissipation. Therefore, embodiments of the wireline tractor systems of this application include energy efficient wireline interfaces.

In a preferred embodiment, the wireline 40 comprises a seven-conductor cable. Power to the wireline tractor 10 is preferably delivered with seven conductors that run in parallel down to the tractor. The electrical current can return to the surface (in order form a complete electrical circuit, current must return to the surface) via one or more armor shields of the wireline 40. The use of seven conductors with a shield for return energy has been found to maximize the available power at the tractor by reducing energy losses along the wireline 40. Such a wireline 40 also improves the reliability of electronic communications to the tractor 10. One suitable wireline is sold by Carnesca under product names 7H42. This is a seven-conductor shielded and crush-resistant wireline cable. Other preferred seven-conductor wirelines 40 are sold by Carnesca under product numbers 7J46, 7H47, and 7Q49. These wirelines 40 have operating voltages of 1000-1200 volts.

In some embodiments, part of the electrical power delivered to the tractor 10 is used to perform tasks such as opening valves or moving sliding sleeves. Also, some tractor operations may require reaching greater borehole depths (e.g., greater than 25,000 feet). In such embodiments and uses, special wireline configurations can be provided. For example, wirelines 40 with relatively larger diameter conductors can be provided. For example, a wireline tractor 10 designed to operate at a depth of about 30,000 feet and use about 5 kW at the tractor might require a specially built wireline that includes conductors that are larger than commonly available wirelines.

A variety of materials may be used for the electrical components of the tractor 10. Various high grade winding insulations (such as irradiated polyvinyl chloride) may be used, which are qualified for various downhole temperature ranges. For example, insulations that are capable of operation at 300-500° F. can be used.

Electrical Connections

The tractor units 10 desirably may be connected to various types of wireline 40 with a multiplicity of commercially available or specialized electrical connectors. These connectors may be hermetically sealed to preventingress of the various downhole fluids. Kemlon Corporation provides various types of connectors used for downhole applications, including "wet stab" connectors that allow for assembly in moist environments. A wet stab is a connection that can be assembled while wet. Field operations are typically conducted in fluid-rich environments, wherein fluids surround the electrical connections. Wet stab connections allow for electrical connections to be established in damp or even wet environments without shorting the electrical connections. Preferably, wet stab connectors are used at the connection of the wireline 40 to the wireline connector 210, as well as other electrical connections downhole (such as connections between tractor units).

The tractor 10 is desirably connected to the wireline 40 with a wireline connector 210. This connector 210 may take several configurations and preferably includes both a mechanical connection and an electrical connection. The mechanical portion of the connection can be designed to take the structural loads of the system, while the electrical system preferably delivers the electrical power and/or control signals.

For convenience of field operations in the preferred embodiments, the wireline connector 212 is a male connector, and the wet stab connector 234 located in the gripper motor housing 202 is female. The gripper motor housing 202 is preferably mechanically attached to the wireline connector 212 by a mechanical coupling that provides a sealed environment. The housing 202 may be equipped with a drain port to drain fluids from inside the tool to the environment. The drain port may include a drain plug that is inserted when running the tool downhole.

For field operations such as installation, the tractor unit 10 may be held in a position in a stuffing box, and the wireline 40 with the wireline connector 212 can be stabbed into the gripper motor housing 202. A stuffing box is an apparatus attached to the top of a wellhead, and which includes a type of gland seal that allows a tool or tractor to be inserted into the well while retaining pressure integrity and fluid control of the well. In a preferred method, the electrical wet-stab connector 234 is first inserted into place, and then the mechanical coupling is formed. The amount of makeup torque to the connection is preferably appropriate for the tractor's diameter, threads type, and anticipated loads. In this preferred embodiment, the makeup torque would range from 500-5000 ft-lbs, with typical makeup torque of approximately 2000 ft-lbs. This refers to the make-up torque for the mechanical connection for the wet stab connector to the wireline connector 210.

Sensors

The tractor 10 or other components of the tractor system can include a variety of sensors to promote the safety of operations and to address certain downhole conditions. These sensors may be electrically powered by the downhole Communications and Control Power Supply 922 (FIG. 9), with output data of the sensors being sent to the surface via the Communications Electronics 928. The sensors' output signals can be used in combination with software and algorithms to better control tractor operation. The connections between the sensors and the tractor controls can be either wireless or hard wired. These sensors are now described.

In certain embodiments, a load cell is provided in either the tractor 10 or in a separate module or sub that is mechanically and electrically connected to the tractor 10. A load cell or transducer can be configured to measure tension loads, compression loads, or both. A load cell that measures both tension and compression is referred to as a T/C load cell. The load cell can measure loads experienced by the wireline 40 when the tractor 10 is in operation. The load cell may be positioned in a pressure-compensated environment for proper operation in certain downhole conditions. The wireline 40 and the wireline connector 212 generally have maximum loads that they can withstand without catastrophic tearing of the wireline 40 or separation of the wireline 40 from the wireline connector 212. An electronic circuit or software commands/module can be utilized to send commands to the electric motors to slow down, stop, or even reverse direction when the measured loads reach certain thresholds that are less than the catastrophic loads, but high enough to warrant remedial actions. Such remedial actions can in certain circumstances prevent overloading of the wireline 40 or wireline connector 212, which can prevent the separation of the downhole tractor assembly from the wireline 40. Such separation may require an expensive fishing operation to retrieve the lost tractor system and bottom hole assembly. In addition, a load cell can include an alarm that notifies the surface controller when the pull of the tractor 10 reaches a predetermined amount. This warning notification helps to prevent the tractor from exceeding the load capacity of the wireline 40 or the wireline connector 212.

Rotation-monitoring sensors can monitor the revolutions of the gripper assembly's drive screw 216 and the power train assembly's drive nut 314. This is useful because the number of revolutions of the drive screw 216 provides an indication of the expansion of the gripper assembly 20, and thus could effectively measure the diameter of the borehole at any location. Similarly, the number of rotations of the drive nut 314 can be used to determine the displacement of each power stroke or reset stroke of the power train assembly 30. Also, a sensor that monitors the rate of rotation of the drive nut 314 can be used to determine the rate at which the tractor 10 is walking.

Temperature sensors, also referred to as thermal sensors, can also be provided. These sensors can be used to determine the temperature external to the tractor 10 in the borehole. For example, temperature sensors can be utilized to measure temperatures of the electric motors. Temperature sensors can be used to determine if the tractor motors need to be cooled (possibly thermoelectrically) or shut off to prevent damage. These temperature sensors can be incorporated into a software-implemented thermal control system for the tractor 10. Such software can run on a surface computer. Alternatively, this thermal control can be implemented by a downhole electronic circuit.

Pressure sensors can also be incorporated into the tractor 10. The pressure sensors can measure either differential pressure (e.g., the difference in pressure between a location within the tractor and an exterior of the tractor) or absolute pressure. In some embodiments, absolute pressure sensors are provided in pressure-compensated chambers. Pressure sensors can also be used to measure well bore pressure. In addition, pressure sensors can be incorporated into the passage-gripping elements 206. These sensors can measure the formation pressure at various locations along the borehole. This information is useful in determining the location of productive hydrocarbons or water. The speed of the tractor and the taking of the data can be adjusted to allow optimum reservoir description. For example, suppose a pressure sensor is located in one of the tractor's passage-gripping elements 206 (FIG. 2). The software for controlling the tractor can be adapted to gather data from the sensor only when the gripping element 206 is in contact with the borehole wall.

In addition, flow meters can be incorporated into the tractor 10 to allow measurement of downhole flow rates either during tractor motion or when the tractor is not moving.

Logging sensors can also be incorporated into the tractor 10 for logging a borehole. Typically, logging sensors have probes that touch the hole wall. These probes are designed to penetrate the mud cake on the hole wall and measure the resistance in the formation (lower resistance is interpreted to mean there is a greater possibility that oil is present). In certain embodiments, resistivity sensors can be incorporated into the passage-gripping elements 206. Due to its direct contact with the formation (and with applied load), a sensor's resistivity measurements at that location are an improvement over prior art sensors' resistivity measurements, because the residual mud cake from drilling is partially displaced and the sensor evaluates the rock rather than rock and drilling mud.

Pressure Compensation

In order to prevent potential damage to the motors and controller electrical components caused by exposure to downhole fluids and pressure, the several electric motors and electrical components may be surrounded by fluid, such as oil or air, within a container. For example, the illustrated gripper motor 214 (FIG. 2) is housed within the gripper motor housing 202, and the illustrated power train motor 310 is housed within the stroke tube 308 (FIG. 3). A sealed atmospheric environment in the container is preferred when electrical components such as PC boards, capacitors, or integrated circuit chips are used, such as in a motor controller, or when heat and lubrication (to gearboxes) are not of significance. When components need both lubrication and heat dissipation, such as with motors and motors with gear boxes, the fluids within said containers are preferably one of various types of oils.

As the tractor unit 10, containing its several motors, progresses to greater borehole depths, the downhole pressure increases, compressing the fluid surrounding the motor. To prevent a fluid differential pressure between the motor's surrounding and its environment from damaging or affecting the motor, a means to provide pressure compensation to the fluid around the motor may be included. This can comprise a moveable piston having one side that is exposed to the downhole borehole pressure, and another side exposed to fluids surrounding the motor. Such a piston may use any type of seal, but for differential pressures of less than 2000 psid, O-ring seals can be sufficient. However, other types of seals, such as metal-to-metal seals, may be acceptable in some embodiments.

For example, referring to FIG. 2, the stroke tube 308 can include a piston 336 positioned forward of the power train motor 310. The motor 310 can be surrounded by a fluid such as oil. The piston 336 has an aft side that is exposed to the fluid surrounding the motor, and a forward side exposed to the borehole pressure. For example, the portion of the stroke tube 308 forward of the piston 336 can have a port for exposure to downhole borehole fluids. This type of pressure compensation is particularly beneficial if an additional motor controller is used in association with the power train motor 310, inside the stroke tube 308. Such a motor controller will likely have electrical components that are sensitive to pressure. This type of pressure compensation is also beneficial if the power train motor 310 has an associated a gear box that needs lubrication and there is concern for overheating.

It will also be appreciated that the gripper motor 214 can be provided in a pressure-compensated environment within the gripper housing 202.

Turning Ability

In some applications it is desirable for the tractor 10 to be capable of having an extremely small turning radius. Described is a configuration that allows small radius turns. A small radius turn for a pipeline application is, for example, approximately 4-5 times the diameter of the pipeline. A small radius turn for a well bore is, for example, 60 degrees per 100 feet of travel.

For both pipelines and borehole, the turning radius that can be achieved is typically limited by the "stick length" of the tractor 10 or the flexibility of the tractor. "Stick length" is the length of a tool or segment of a tool that remains rigid under normal operations, and flexes only slightly. The "flexibility" is the product of the effective polar moment of inertia and the modulus of elasticity of the tool. When the tool or tool segment is rigid, the stick length is the maximum tool length or segment that can pass through a curved borehole without binding against the borehole wall. When a tool has moderate flexibility, a tool or tool segment can slide through a borehole of a particular radius of curvature without permanent deformation or yielding.

In order to achieve the objective of passing through highly radius of curvature boreholes, a special connection for the tractor units 100 can be used. To achieve a desired flexibility, a restrained ball and socket joint may be used at the connection between two tractor units 100. The ball section may include one or more seals to prevent fluid incursion into the joint. The ball and socket joint can be hollow to allow for the passage of electrical lines therethrough. The ball unit is preferably equipped with a retaining flange to prevent separation of the joint when pulling out of the borehole.

The hollow ball and socket joint can allow a wide range of arc for a single-unit or multi-unit tractor system, preferably in all three dimensions, to facilitate a high turning radius. The ball and socket joint may be connected into either the electric gripper assembly 20 or the electric power train assembly 30. Thus, the tractor system can be jointed at specific locations within a tractor unit 10 and also between tractor units 10, which dramatically increases the turning radius and hence the number of serviceable pipeline and borehole applications.

Multi-Unit Tractor Systems

Figure 4:
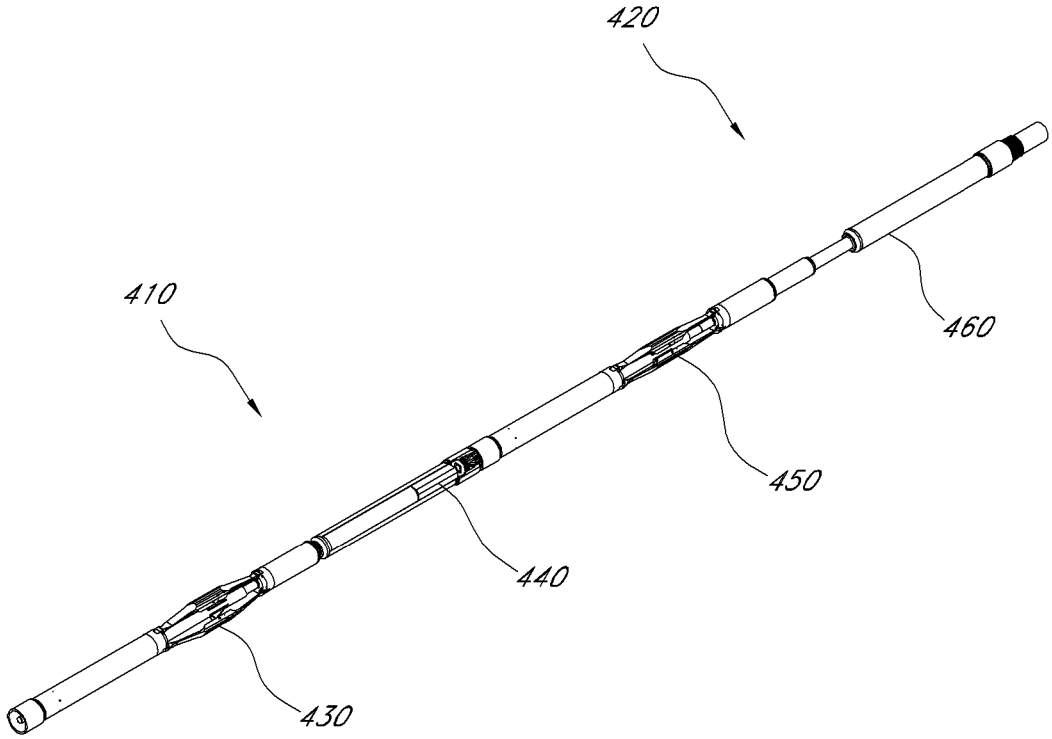
FIG. 4 is a perspective view of an embodiment of a tractor system having two electric gripper assemblies and two electric power train assemblies.

FIG. 4 shows an embodiment of a multi-unit tractor system 400. In the illustrated embodiment, the system 400 includes two tractor units 10 of the type shown in FIG. 1. However, those skilled in the art will appreciate that any number of tractor units can be connected together end-to-end to form the tractor system 400. Also, each tractor unit need not be identical to the tractor unit 10 shown in FIG. 1. Each tractor unit of the system 400 preferably includes at least one electric gripper assembly and at least one electric power train assembly.

The illustrated tractor system 400 includes an aft tractor unit 410 (the tractor unit nearest to the ground surface) and a forward tractor unit 420 (the tractor unit nearest the bottom of the borehole). For the purposes of this description, tractor units between the aft unit 410 and the forward unit 420 are referred to as intermediate tractor units. In the illustrated embodiment, the aft tractor unit 410 includes an aft electric gripper assembly 430 and an aft electric power train assembly 440, and the forward tractor unit 420 includes a forward electric gripper assembly 450 and a forward electric power train assembly 460.

In the illustrated embodiment of the two-unit tractor system 400, the aft power train assembly 440 is physically and electrically connected to the forward gripper assembly 450. This is referred to herein as a "head-to-tail" arrangement, in which the tractor units 410 and 420 are connected in a repeating pattern. In embodiments of head-to-tail arrangements, a plurality of connected tractor units (including more than two units) has a repeating pattern of relative positions of the gripper assemblies and power train assemblies.

In another embodiment, the aft power train assembly 440 is physically and electrically connected to the forward power train unit 460, with the forward gripper assembly 450 being positioned forward of the forward power train unit 460. This is referred to herein as a "head-to-head" arrangement. In embodiments having more than two tractor units, a head-to-head arrangement may require that a gripper assembly connects to another gripper assembly, and that a power train assembly connects to another power train assembly. Thus, some of the gripper assemblies will have male connectors, and others will have female connectors. Likewise, some of the power train assemblies will have male connectors, and others will have female connectors. A head-to-head arrangement can have the disadvantage of doubling a required inventory of tractor units. It will be appreciated that a multi-unit tractor system can include pairs of tractor units that are connected head-to-head (or its complement, tail-to-tail), as well as pairs of tractor units that are connected head-to-tail.

The tractor units 410 and 420 of the illustrated head-to-tail system 400 are modular, in the sense that each tractor unit can be substantially identical. In certain embodiments, the tractor units have lengths less than about 20 feet. The tractor units of a tractor system need not be connected directly to one another. Rather, they may be positioned at different positions in a tool string. A wireline string can include any number of tractor units, such as two, three, four, or more units.

The number of tractor units can be selected based on the intended application of the tractor system. For example, when traversing a downhole washout (i.e., a region of greater borehole size), it may be necessary to connect as many as three or more tractor units in series. In this example, it is possible to use a tractor unit positioned in a portion of the borehole that is small enough to grip with the gripper assembly, with the other tractor units being inactive. When the activated tractor unit encounters the washout, it can be deactivated and another tractor unit can be activated to grip a smaller borehole section that is past the washout. In this manner, a multi-unit tractor system can traverse large downhole washouts.

In some embodiments, two tractor units of a multi-unit tractor system may be separated by a spacer unit, which preferably provides a conduit for the wireline 40. The spacer unit can be of any practical length, for example within 10-200 feet, or even greater than 200 feet. This embodiment can also traverse washouts. For example, suppose a spacer unit is provided between the tractor units 410 and 420 of the tractor system 400. When the forward tractor unit 420 encounters a washout while moving downhole and is unable to grip the borehole wall, it can be turned off. The aft tractor unit 410 can then be turned on to grip the borehole aft of the washout, and to provide motion up to the washout. Then, when the aft tractor unit 410 encounters the washout, it can be turned off. The forward tractor unit 420 can then be turned on to grip the borehole forward of the washout, to thereby continue downhole motion of the tractor system 400 until both the forward and aft units 420 and 410 are able to grip the borehole wall forward of the washout.

Figure 5:
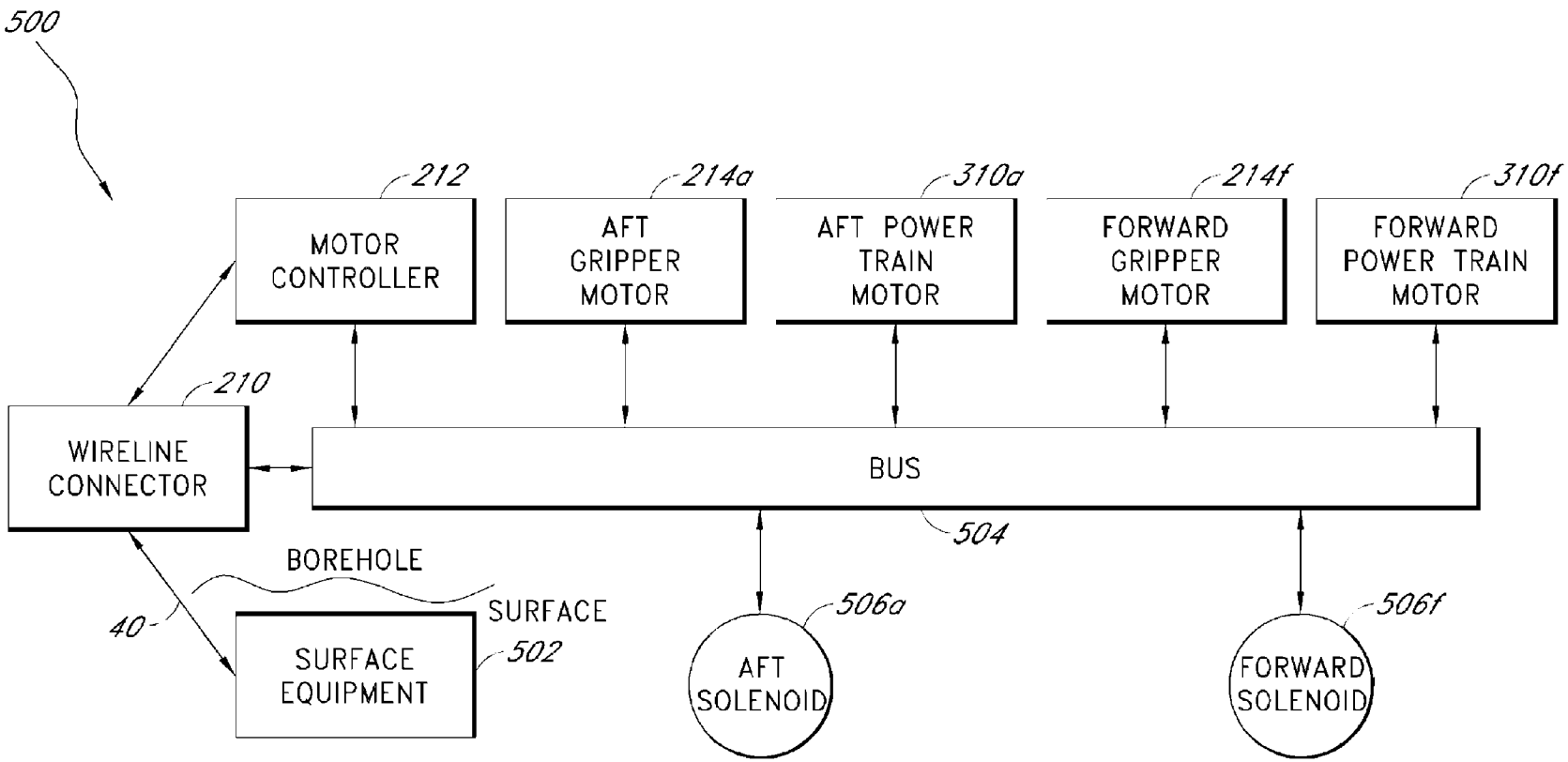
FIG. 5 is a schematic of an embodiment of an electronic control system for the tractor system of FIG. 4.

FIG. 5 is a schematic of an embodiment of an electronic control system 500 for the tractor system 400 of FIG. 4. The control system 500 includes surface equipment 502 preferably comprising a computer running tractor control software, as well as an electrical power supply. The system 500 also includes a wireline 40, wireline connector 210 (FIG. 2), a motor controller 212, and an electrical bus 502 providing connectivity from the motor controller 212 to the gripper and power train motors of the tractor units 410 and 420. In particular, the aft tractor unit 410 includes a gripper motor **214*a* and a power train motor 310*a*, and the forward tractor unit 420 includes a gripper motor 214*f* and a power train motor 310*f*. Also shown is a solenoid unit 506*a* of the aft tractor unit 410, and a solenoid unit 506*f* of the forward tractor unit 420**.

The wireline 40 delivers electrical power and electronic control signals from the surface equipment 502. The power and signals are delivered by the wireline connector 212 to the tractor units 410 and 420 via the common electrical bus 504. In particular, the motor controller 212 sends the commands and power to the aft gripper motor 214*a*, aft power train motor 310*a*, the forward gripper motor 214*f*, and the forward power train motor 310*f*. In addition, power is delivered to the solenoid units 506*a* and 506*f*. The solenoid units 506*a* and 506*f* are preferably associated with clutch units of the respective tractor units 410 and 420, each clutch having an actuated position in which the clutch unit couples the gripper motor with respect to a drive screw 216 (FIG. 2), and a de-actuated position in which the clutch unit disengages the gripper motor with respect to the drive screw 216. Each solenoid unit 506*a* and 506*f* is preferably configured to move an associated clutch unit to its de-actuated position in the event of an interruption of electrical power to the solenoid unit. The consequent disengagement of the gripper motor with respect to the drive screw provides failsafe functionality as described above, allowing the gripper assembly to retract from the borehole surface.

FIGS. 6*a*-6*d* illustrate power usage over time for a typical walking cycle for the gripper motors 214*a* and 214*f* and power train assemblies 310*a* and 310*f* of two tractor units 410 and 420 of a two-unit tractor system, wherein the tractor units are connected head-to-head. In this example, two motors are operated simultaneously. One skilled in the art can envision other walking schemes that involve the operation of only one motor at a time or three or more motors at simultaneously. FIGS. 6*a*-6*d* illustrate events numbered 1-16.

Figure 6A:
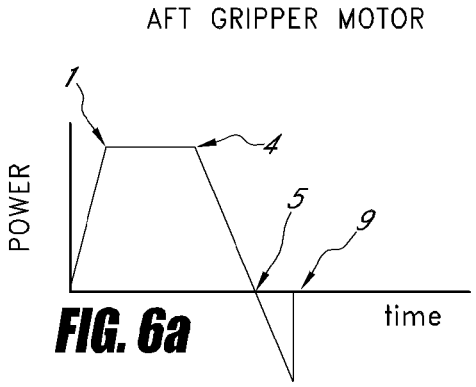
FIGS. 6*a*-6*d* are curves showing power-time curves for the gripper assemblies and power train assemblies of an embodiment of a two-unit tractor system, during longitudinal motion of the tractor system.
Figure 6C:
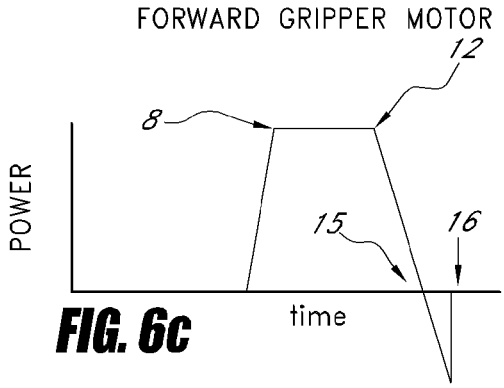
Figure 6B:
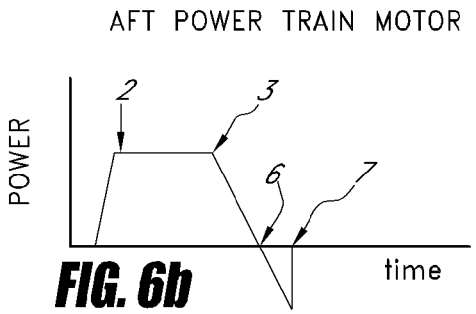

With reference to FIGS. 6*a* and 6*b*, the tractor system's motion begins with the aft gripper motor 214*a* being activated (event 1). The aft gripper motor 214*a* moves rapidly until the aft gripper assembly 430 engages the borehole wall, after which power is maintained on the motor 214*a* to maintain the gripper assembly 430 in its expanded, borehole-gripping condition. Next, the aft power train motor 310*a* is activated (event 2), resulting in the longitudinal movement of the tractor system downhole due to a power stroke of the aft power train assembly 440. When the aft power train assembly 440 has completed its stroke or travel, the aft power train motor 310*a* is deactivated (event 3). Next, the aft gripper motor 214*a* is deactivated (event 4) to disengage the aft gripper assembly 430 from the borehole wall. Next, the aft gripper motor 214*a* is activated in reverse (event 5) to begin a reset operation of the aft gripper assembly 430. Next, the aft power train motor 310*a* is activated in reverse (event 6) to begin a reset stroke of the aft power train assembly 440. The reverse rotation of the aft power train motor 310*a* continues until the aft power train assembly 440 is reset (event 7) and ready for a subsequent power stroke.

Figure 6D:
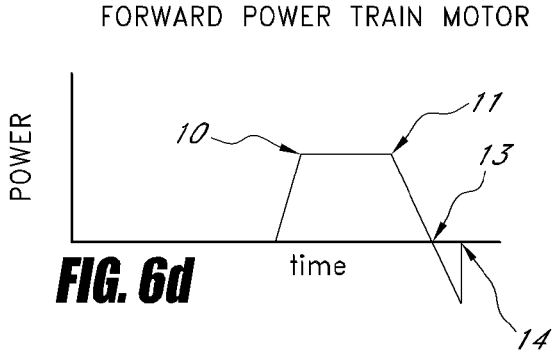

Reference is now made to FIGS. 6*c* and 6*d*. Next, the forward gripper motor 214*f* is activated (event 8). The motor 214*f* moves rapidly until the forward gripper assembly 450 engages the borehole wall, after which power is maintained on the motor 214*f* to maintain the gripper assembly 450 in its expanded, borehole-gripping condition. Next, the aft gripper motor 214*a* completes its reset movement and de-energizes (event 9). Next, the forward power train motor 310*f* energizes (event 10), resulting in the longitudinal movement of the tractor system downhole due to a power stroke of the forward power train assembly 460. Next, the forward power train motor 310*f* ends its power stroke and begins to de-energize (event 11). Next, the forward gripper motor 214*f* is de-energized (event 12), and the forward gripper assembly 450 begins to retract. Next, the forward power train motor 310*f* is activated in reverse (event 13) to begin a reset stroke of the forward power train assembly 460. Next, the forward power train motor 310*f* completes its reset mode and is de-energized (event 14). Next, the forward gripper motor 214*f* is activated in reverse (event 15) to begin a reset operation of the forward gripper assembly 450. Finally, the forward gripper motor 310*f* completes its reset movement and is de-energized (event 16). Then the process is repeated and the walking of the tractor system continues.

Regarding the portions of the walking cycle when the gripper assemblies 430 and 450 are in their expanded, borehole-gripping positions (i.e., the time period between events 1 and 4, and the time period between events 8 and 12), several methods may be used to maintain contact and hence traction between the gripper assemblies and the borehole wall. In the example explained above, the electrical power is constantly maintained on the corresponding gripper motor 214*a* and 214*f*. In one embodiment, this is accomplished by the motor controller 212. Alternatively, a mechanical or hydraulic device may be used to lock the gripper assembly in place once it is in its expanded, borehole-gripping position. For these alternative embodiments, a failsafe system for the locking device may be incorporated to allow automatic disengagement of the gripper assembly in the event of a power outage. Electronically, this could be achieved with an electrically controlled clutch unit. Hydraulically, this could be accomplished with the release of pressurized fluid from a chamber to a clutch unit.

Tractor with Two Grippers and One Power Train

Figure 7:
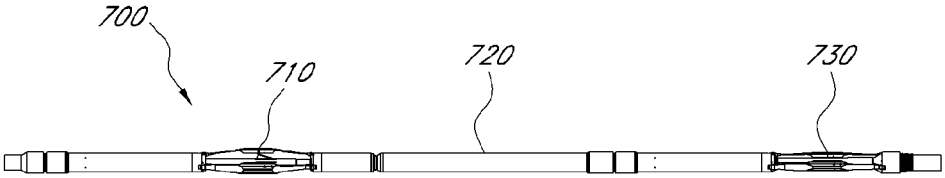
FIG. 7 is a side view of an embodiment of a tractor having two electric gripper assemblies and one electric power train assembly.

FIG. 7 shows an embodiment of a tractor 700 comprising an aft electric gripper assembly 710, an electric power train assembly 720, and a forward electric gripper assembly 730. In certain embodiments, the gripper assemblies 710 and 730 are configured substantially as described above with respect to FIGS. 2, 2*a*, and/or 2*b*. In certain embodiments, the power train assembly 720 is configured substantially as described above with respect to FIGS. 3 and 3*a*. The tractor 700 is useful because it minimizes the amount of energy required for operation, reduces overall tractor length (compared to tractor systems having two gripper assemblies and two power train assemblies), and reduces tractor manufacturing costs. Such a tractor 700 can be used for a variety of downhole tasks as described previously, including open borehole logging, cased borehole logging, setting of plugs, milling, and borehole cleanouts. In FIG. 7, the aft gripper assembly 710 is shown in an expanded position, and the forward gripper assembly 730 is shown in a retracted position. It will be understood that both gripper assemblies can preferably have both positions.

Embodiments of the tractor 700 use less energy in borehole gripping and power train extension. In wireline systems, a substantial portion of the energy delivered from the ground surface through the wireline is lost due to electrical resistance of the wireline. For example, at well depths of about 25,000 feet, approximately only 50% of the delivered power at the surface is available at the tractor. Thus, if 5.2 kW of power is delivered at the surface at 900 V (DC), only approximately 2.6 kW of power will likely be available to the tractor at such well depths.

Preferably, the tractor 700 is configured to hold the gripper assemblies 710 and 730 in their expanded positions by mechanical locking devices or mechanisms, which can be held in locking positions by electrically controlled failsafe mechanisms as described above. Such locking devices can help reduce the required power of the gripper assemblies 710 and 730, by reducing the power necessary to remain in their expanded positions. This in turn allows the power train assembly 720 to use most of the energy delivered to the tractor 700, for producing longitudinal movement of the tractor.

In certain embodiments, the gripper assemblies 710 and 730 are configured to retract in a manner that uses little or even no electrical power. For example, mechanical springs can be employed to retract the gripper assemblies 710 and 730 when electrical power to their associated (and optionally provided) electrically controlled failsafe mechanisms (e.g., solenoids) is interrupted. If mechanical locking devices are used, the interruption of power to the failsafe mechanisms can cause the locking devices to release the gripper assemblies from their expanded positions, and the springs can bias the gripper assemblies to their retracted positions. In embodiments employing passage-gripping elements 206 (FIG. 2) that are flexible beams 232 (FIG. 2*a*), the beams 232 may have a proclivity to retract from their radially flexed positions without the use of additional springs.

Additionally, in embodiments in which the power train assembly 720 is configured similarly to the power train assembly 30 of FIG. 3, the lead screw 312 of the power train assembly 720 may comprise a ball screw with ball bearings. This reduces the rotational resistance of the lead screw 312, as well as the energy consumption associated with activation of the power train motor 310. On the other hand, some ball screws do not handle power train assembly bending stresses well, whereas other lead screws handle bending stress more effectively. Thus, in certain embodiments, the gripper assembly uses a ball screw and the power train assembly uses a lead screw that is not a ball screw. The power train assembly 720 preferably has a long (e.g., 30-60 inches, preferably about 48 inches) lead screw 312 to maximize the length and time associated with each power stroke, which can further reduce energy consumption. It should also be noted that any of the other power train assemblies and gripper assemblies described herein can use a ball screw with ball bearings for reduced rotational resistance.

As noted above, the elimination of one power train assembly (compared to tractor systems having two power train assemblies) allows the tractor 700 to be shorter, facilitating faster rig up and rig down, and easier transportation. In addition, the cost for a second power train assembly in each tractor is eliminated.

In general, gripper assemblies 710 and 720 of different sizes can be provided, making it possible to replace the gripper assemblies with larger or smaller ones to suit differently sized boreholes. In a given tractor 700, the installed gripper assemblies 710 and 730 preferably have substantially or exactly the same size. In certain embodiments, it is possible to replace the gripper assemblies 710 and 730 without modifying the power train assembly 720. In certain embodiments, a tractor 700 can use gripper assemblies 710 and 730 configured to grip onto boreholes with diameters as large as 16 inches, facilitating the traversal of such larger boreholes.

Table 1 shows the characteristics of one embodiment of a tractor 700 designed for use within boreholes having diameters within 6.0-9.5 inches. This embodiment can operate in cased or open boreholes.

TABLE 1

| Parameter | Characteristic |
|---|---|
| Tool outside diameter (OD) when gripper assemblies are collapsed | 5 inches |
| Tool OD when gripper assemblies are expanded | 9.5 inches |

TABLE 1-continued

| Parameter | Characteristic |
|---|---|
| Length | <20 feet |
| Maximum well pressure | 8000 psi |
| Maximum temperature | 300° F. |
| Speed range without load | 750-1000 feet/hour |
| Maximum pulling force | 2400 lbs |
| Maximum turning capability (dog-leg) | 30 degrees per 100 feet of travel |
| Tensile strength | 30,000 lbs |
| Wireline configuration | 7-conductor Hepta |
| Magnetic signature | None |
| Estimated weight | 350 lbs |
| Maximum operational distance from surface | 25,000 feet |

Figure 8A:
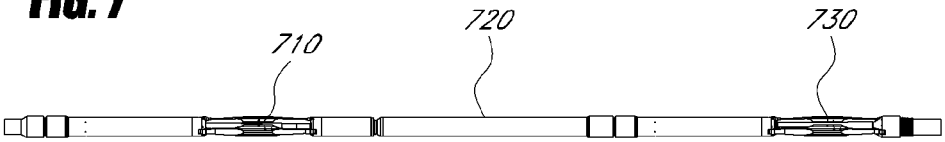
FIGS. 8*a*-8*f* are side views illustrating a method of longitudinal movement for the tractor of FIG. 7.
Figure 8B:
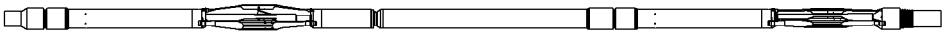
Figure 8C:
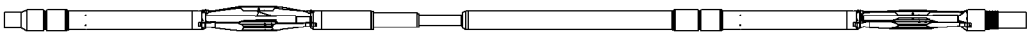
Figure 8D:
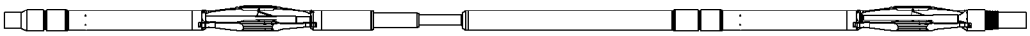
Figure 8E:
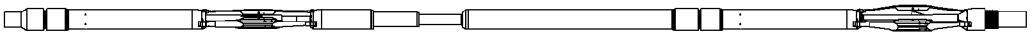
Figure 8F:
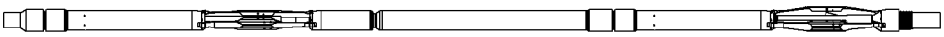

FIGS. 8*a*-8*f* illustrate a sequence of steps by which the tractor 700 of FIG. 7 walks longitudinally within a borehole. In FIG. 8*a*, the gripper assemblies 710 and 730 are both retracted, and the power train assembly 720 is contracted. As shown in FIG. 8*b*, the aft gripper assembly 710 expands to grip onto the borehole surface. As shown in FIG. 8*c*, the power train assembly 720 then elongates to propel the forward gripper assembly 730 forward. As shown in FIG. 8*d*, the forward gripper assembly 730 then expands to grip onto the borehole surface. As shown in FIG. 8*e*, the aft gripper assembly 710 then retracts from the borehole surface. Finally, as shown in FIG. 8*f*, the power train assembly 720 then contracts to pull the aft gripper assembly 710 forward. In a next step (not shown), the aft gripper assembly 710 can expand to again grip the borehole surface. The forward gripper assembly 730 can then retract so that the tractor 700 resumes the state shown in FIG. 7*b*. The cycle involving steps 8*b*-8*f* can the repeat to continue the walking the process.

The tractor 700 is preferably bidirectional, simply by adjusting the sequence of steps shown in FIGS. 8*a*-8*f*. Thus, by careful selection of the sequence of forward and reverse activation of the motors of the gripper assemblies 710 and 730 and the power train assembly 720, the tractor 700 can move either downhole or uphole. This is highly beneficial because, by operating in reverse, the tractor 200 can assist in the retrieval of the bottom hole assembly (BHA). For example, on average the wireline 40 twists significantly during usage (e.g., over 200 times in one operation), even when the wireline is coupled to the tractor system and BHA by a swivel. This makes it more difficult to retrieve the BHA from the borehole, because twisting of the wireline against the borehole wall produces drag friction forces that can become so great as to exceed the strength of the wireline. This problem is partially ameliorated by the tractor's ability to move in reverse.

Figure 9:
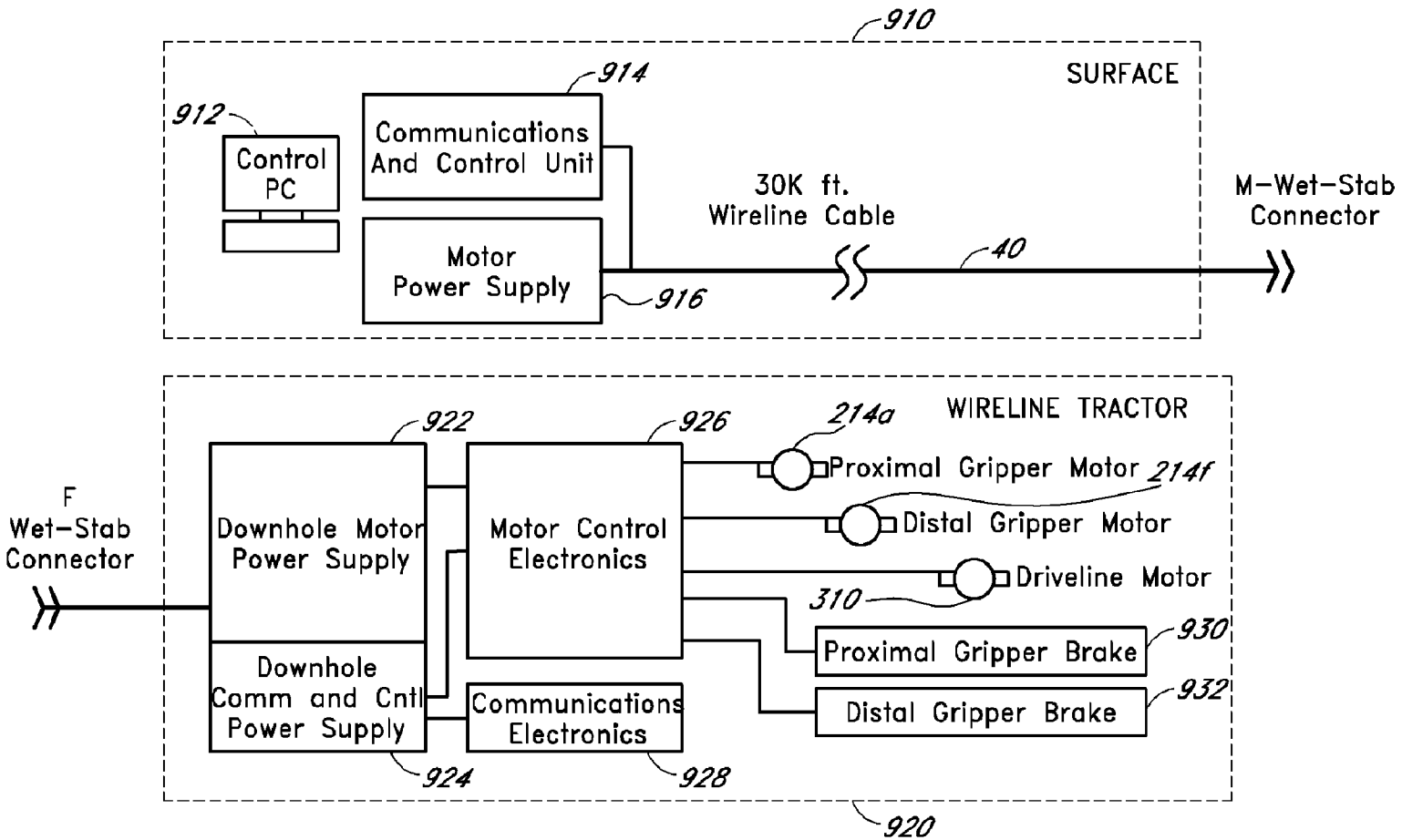
FIG. 9 is a schematic of a system for powering and controlling the tractor of FIG. 7.

FIG. 9 schematically illustrates one embodiment of a system 900 for powering and controlling the tractor 700 of FIG. 7. It will be appreciated that a similar system can be provided for other tractor embodiments disclosed herein. The illustrated system 900 includes surface equipment 910 and downhole equipment 920, which are connected by a wireline 40. In this particular embodiment, the surface equipment 910 includes a computer 912, a communications and control unit 914, a motor power supply 916, and an upper end of the wireline 40. The computer 912 can be a personal computer with communications and control software. The surface equipment 910 preferably also includes surface connection apparatus for connecting the wireline 40 to the communications and control unit 914 and the motor power supply 916.

In this particular embodiment, the downhole equipment 920 includes a downhole motor power supply 922, a downhole communication and controls power supply 924, motor control electronics 926, and communications electronics 928.

The tractor 700 includes an aft gripper assembly 710 (FIG. 7) having an aft gripper motor 214*a* (FIG. 2), a forward gripper assembly 730 having a forward gripper motor 214*f*, and a power train motor 310 (FIG. 3).

As shown in FIG. 9, the downhole equipment 920 can include an aft gripper brake 930 and a forward gripper brake 932, which can be mechanical locking devices that lock the gripper assemblies in their movement-limiting positions, as described elsewhere herein. The mechanical locking devices can be configured to release the gripper assemblies from their movement-limiting positions if electrical power to the motors is interrupted, such as by employing solenoids as described elsewhere herein.

Figure 9A:
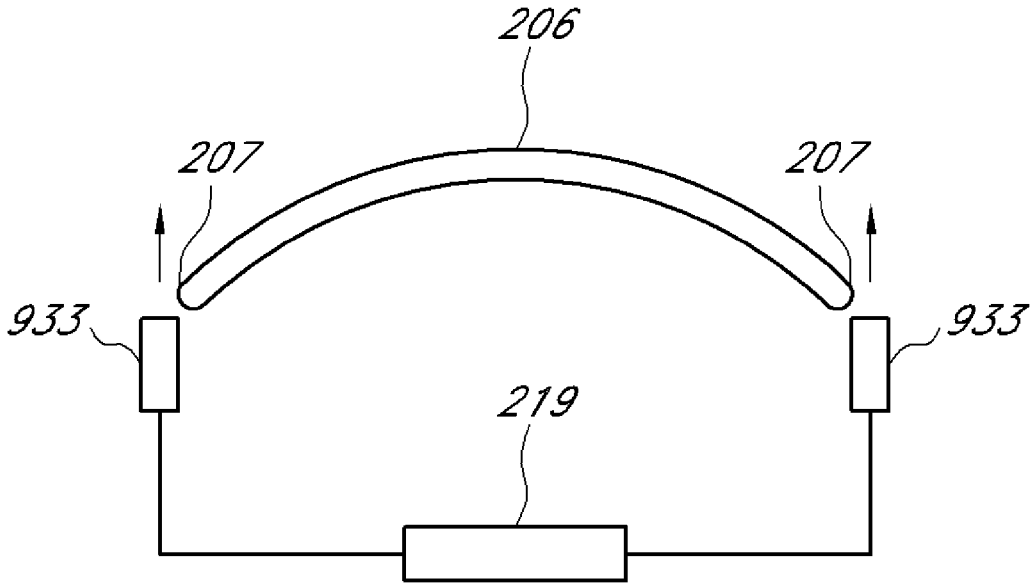
FIG. 9*a* is a schematic illustration of an embodiment of a mechanical locking device for locking a gripper assembly in a movement-limiting position with respect to a passage.

FIG. 9*a* shows one possible type of mechanical device that can be used as a brake 930 or 932. In particular, FIG. 9*a* shows mechanical impeders 933 (e.g., pushrods), each of which has a first position (not shown, but shifted upward in the figure, as indicated by the arrows) in which it mechanically prevents at least one of the passage-gripping elements 206 (FIG. 2) from retracting, such as by insertion of the impeder 933 into a position at which it prevents an end 207 of one of the gripping elements 206 from moving longitudinally away from the other end 207 of the gripping element when the gripping element is radially expanded. The impeder 933 can also have a second position (as shown) in which it is not so inserted. A solenoid 219 can move the impeder 933 to its second position if electrical power is interrupted, facilitating failsafe operation. One or more impeders 933 can be provided for each gripping element 206. In one implementation, two such impeders 933 operate in tandem for each set of one or more gripping elements 206. In one implementation, the impeders 933 are inserted into pin slots that are used to couple the gripping elements 206 to the toe anchors 204 and 208, as described above. Such impeders 933 can be employed at each end of each passage-gripping element 206, or alternatively only on one end of each gripping element 206. It will be appreciated that other types of brakes 930 and 932 can be provided.

Many of the components of the surface equipment 910 and downhole equipment 920 can be purchased and integrated into the tractor system. For example, Scotland Electric International (LTD) of Scotland, UK commercially provides personal computer interface controls and monitors (i.e., computer, software, data acquisition), high voltage surface power supply units (element 916), communications and power interface modules (element 914), downhole electronic line conditioning units, downhole electronics over/under voltage protection units, downhole electronics for communications on power interface units (element 928), downhole electronics for DC/DC power supply units (DC transformer to step down the electrical voltage, element 926), downhole electronics for tool sensor power and conditioning, downhole electronics for tool sensors isolated data interfaces, and downhole electronics for data monitoring and control processors. Alternatively, Scientific Data Systems of Houston, Tex. provides surface control and communications units as well as a proprietary software packages ("Warrior") that can be adapted for use in the tractor 700. Other providers supply downhole power supplies and tractor-surface communications hardware. The tractor can use different types of communication links from the ground surface to the tractor. In one embodiment, the tractor system uses an RS232 link in a DC power supply.

Regarding the downhole equipment 920, many subsystems are commercially available and may be integrated into the tool. Specifically, Scotland Electronics International Ltd. provides downhole communications electronics units (element 928) and associated software. Other sources can provide the motor control electronics. Downhole power supply units (element 922) are provided by Universal Voltronics Power Supplies.

When operated at temperatures above 225° F., many motor controllers and electronic components are unable to achieve a long life. Thus, the motor controllers and other components of the tractor 700 (and preferably the other tractors described herein) are preferably selected or tested to verify reliable operation at a higher temperature, such as 300° F. In addition, heat dissipation features and pressure-compensation can be incorporated to increase motor life, as discussed above. Accordingly, the downhole electronics can be housed in an atmospheric chamber to prevent damage to the electronics caused by downhole pressures.

Comparison of Tractor Configurations

Disclosed above are embodiments of tractor systems involving two gripper assemblies and two power train assemblies. In these tractor systems, the power train assemblies can operate one at a time or simultaneously. Also disclosed above are embodiments of tractors involving two gripper assemblies and one power train assembly. These different configurations and modes of operation are now compared, with reference to Table 2 shown below. It should be understood that the estimated maximum speeds are only for certain embodiments.

TABLE 2

| Tractor system description | Estimated maximum speed range (ft/hr) * | Advantages | Disadvantages |
|---|---|---|---|
| Two gripper assemblies and one power train assembly | 850-1150 | Only three motors. Complies with existing safety requirements of surface voltages. Shorter, lighter, and less expensive. | Power train motor operating constantly, involving potential for short life. Tractor failure occurs when power train motor fails. |
| Two gripper assemblies and two power train assemblies, with only one power train assembly motor operating at a time | 1000-1350 | Faster operation than single drive. Can drive two power train assemblies at shallow depth and single power train assembly at the bottom of the hole. Power train redundancy allows tractor operation if one power train assembly fails | Tool is longer, heavier, more complex, and more expensive than tractor with one power train assembly. |
| Two gripper assemblies and two power train assemblies, with simultaneous operation of the power train motors | 2000-2300 | Runs faster than other configurations at light loads. Can convert to single power train operation if electrical power is limited. Power train redundancy allows tractor operation if one power train fails | Tool is longer, heavier, more complex, and more expensive than tractor with one power train assembly. |

(* with load of 2300 lbs and 25,000 feet wireline; 900 V power at surface)

Summary of Features and Benefits

Embodiments of the tractors and tractor systems described above have a variety of features and benefits, which are now summarized.

One advantage of embodiments of the tractor systems of this application is lower cost for operations. Because embodiments require only simple wireline and minimal surface equipment when compared to performing the same operation with either a coiled tubing rig or a rotary rig, the costs to perform tasks such as open hole logging or open hole perforation are dramatically reduced.

Another feature or advantage of embodiments of the tractor systems of this application involves the ability to convey various bottom hole assemblies. Embodiments may be used with a wide variety of downhole tools to perform a wide variety of operations. Embodiments may be used with logging tools to perform logging in open holes or cased holes. Embodiments may be used to deliver perforation guns to perforate casings or formations. Embodiments may be used to perform various types of surveys, such as casing wear. Embodiments may be used in conjunction with other support tools such as a voltage conversion subs. Embodiments may be used with various mechanical devices such as jars that could be used to assist in the release of stuck wireline. Embodiments may be used in conjunction with a variety of fishing tools that aid retrieval of equipment lost downhole. Embodiments may be used in conjunction with commercially available tools provided by major and specialty equipment suppliers.

Another feature or advantage of embodiments of the tractor systems of this application involves the use of electric gripper assemblies. Several types of high expansion grippers with large contact surfaces can be powered by the electric motor and lead screw design described above. This allows effective gripping both in open holes and cased holes. The passage-gripping elements may be linkages or continuous beams, wherein the latter contributes to the failsafe characteristics of the assembly.

Another feature or advantage of embodiments of the tractor systems of this application involves the use of materials that are resistant to acids and other downhole fluids. Embodiments are constructed from materials such as Inconel, MP35N, and copper beryllium, which are resistant to acids, hydrogen sulfide, and downhole fluids and thus allow operation in almost all types of wells.

Another feature or advantage of embodiments of the tractor systems of this application involves the use of an electric power train assembly. Embodiments of the power train assembly have a unique electrically powered multi-stage telescoping assembly that provides the longitudinal movement of the tractor. Moreover, the motor of the power train assembly controls the speed of the tractor's motion. In addition, the power train assembly can provide structural rigidity to the tractor, which in some cases may assure its retrievability from the borehole. The power train assembly can be configured to transmit torque from the power train motor to the passage-gripping elements, which in turn transmit it to the borehole. This helps to prevent the rotational output of the motor from being delivered to the wireline, which could undesirably twist the wireline.

Another feature or advantage of embodiments of the tractor systems of this application involves the provision of single tractor units and multi-unit tractor systems. In some embodiments, a tractor unit includes one electric gripper assembly and one electric power train assembly. A single tractor unit can be used alone, or in combination with other tractor units in a multi-unit system. This provides for greater flexibility and applicability for various field operations. An individual tractor unit can be sufficiently short to facilitate easy installation in individual stages that are stabbed together and made up quickly over the hole, thus helping to reduce service costs. A multi-unit tractor system can excel in traversing borehole washouts. A multi-unit tractor system can include two, three, or more tractor units connected together end-to-end. In usage, a multi-unit tractor system can be operated such that units able to grip the borehole are expanded, and units unable to grip the borehole (e.g., due to a washout) are not activated.

Another feature or advantage of embodiments of the tractor systems of this application involves wireline command and control. Embodiments of wireline tractors can operate with conventional wireline commonly used in the industry, which makes it unnecessary to significantly modify the equipment. A command center may be located at the ground surface with computer and software, and the tractor can include simple motor control modules. This helps to minimize the downhole electronics, which are exposed to elevated temperatures. Electronic commands delivered through the wireline can control tractor movements, such as causing the tractor to move forward or in reverse.

Another feature or advantage of embodiments of the tractor systems of this application involves methods of walking. The designs of embodiments of the electric gripper assemblies and the power train assembly facilitate several methods of tractor walking. In one embodiment, two power train motors are operated simultaneously. In another embodiment, two power train motors are operated sequentially. The individual actions by the motors are typically power on, power off, and reverse on. These in various combinations make it possible for embodiments of the tractor to move substantially continuously. In addition, various methods may be used to perform operations that enhance the tractor's usefulness. For example, embodiments of the tractor can walk into an open hole while carrying logging tools and then turn off. Then, the wireline can be pulled up at a carefully selected speed to enhance the logging data collection. The tractor's reverse walking ability may be used primarily for reducing drag when retrieving the BHA. In another embodiment, walking sequences may be based on use of one motor at a time, or even three or more motors used simultaneously, depending upon the availability of wires in the conductor and power delivery, and other parameters.

Another feature or advantage of embodiments of the tractor systems of this application involves the ability to use downhole tools that employ electrical power and/or electronic signals delivered via wireline. Embodiments of wireline tractors may be configured to convey the electrical power and/or electronic signals to downhole tools connected forward of the tractor. This may facilitate the usage of tools further downhole than in other systems. For example, open hole logging tools may be located forward of the tractor and thus further downhole. This can be significant for holes that are difficult to reach, even with the use of a tractor. In addition, tools may be located aft of a wireline tractor.

Another feature or advantage of embodiments of the tractor systems of this application involves the ease of operation and transportation. Because embodiments are sufficiently short (such as less than twelve feet), individual tractor units may be assembled in the field, such as on the ground or over the hole. Because of their reduced length, embodiments of the tractor units can be easily transported via helicopter rather than boat to offshore applications.

Another feature or advantage of embodiments of the tractor systems of this application involves failsafe mechanisms for the gripper assemblies. Embodiments have failsafe mechanisms that react to a loss of electrical power by permitting the automatic disengagement of the passage-gripping elements from the hole wall, and thus safe retrieval of all equipment from the borehole. The electric gripper assembly can be equipped with a solenoid-operated clutch that disengages in the event of power failure, thus assuring that the gripping elements retract from the borehole wall, facilitating easier tractor retrieval.

Another feature or advantage of embodiments of the tractor systems of this application involves a high turning radius. Embodiments may have "ball and socket" connections that allow the tool to have a high turning radius, thus allowing operations in highly curved and deviated boreholes and certain pipeline applications.

Another feature or advantage of embodiments of the tractor systems of this application involves the use of electricity. Embodiments may be powered by self-contained sources such as batteries, or alternatively by electrical power from the ground surface via a wireline. Electrical power may be sent downhole in a convenient form for transportation down long wireline (e.g., high voltage power) and then optionally converted to another convenient form (e.g., high current) for downhole motor operation. Further, the conversion downhole may be accomplished within a voltage converter sub that is a standalone unit or packaged within a wireline tractor. The tractor is preferably configured to optimize the amount of electrical energy delivered to the tool with considerations for surface safety (voltage) and energy transmission losses. Embodiments are compatible with specially designed wirelines that have higher power transmission capabilities.

Gripper Expansion Assemblies

With reference again to FIG. 2, as noted above, embodiments of tractors include gripper assemblies 20 that produce longitudinal motion of an extension element (e.g., a toe nut 218 or drive screw 216). In certain embodiments, each gripper assembly 20 has an associated gripper expansion assembly that converts the longitudinal movement of the extension element into radial expansion and retraction of associated passage-gripping elements 206. Several embodiments of gripper expansion assemblies are now described.

Figure 10:
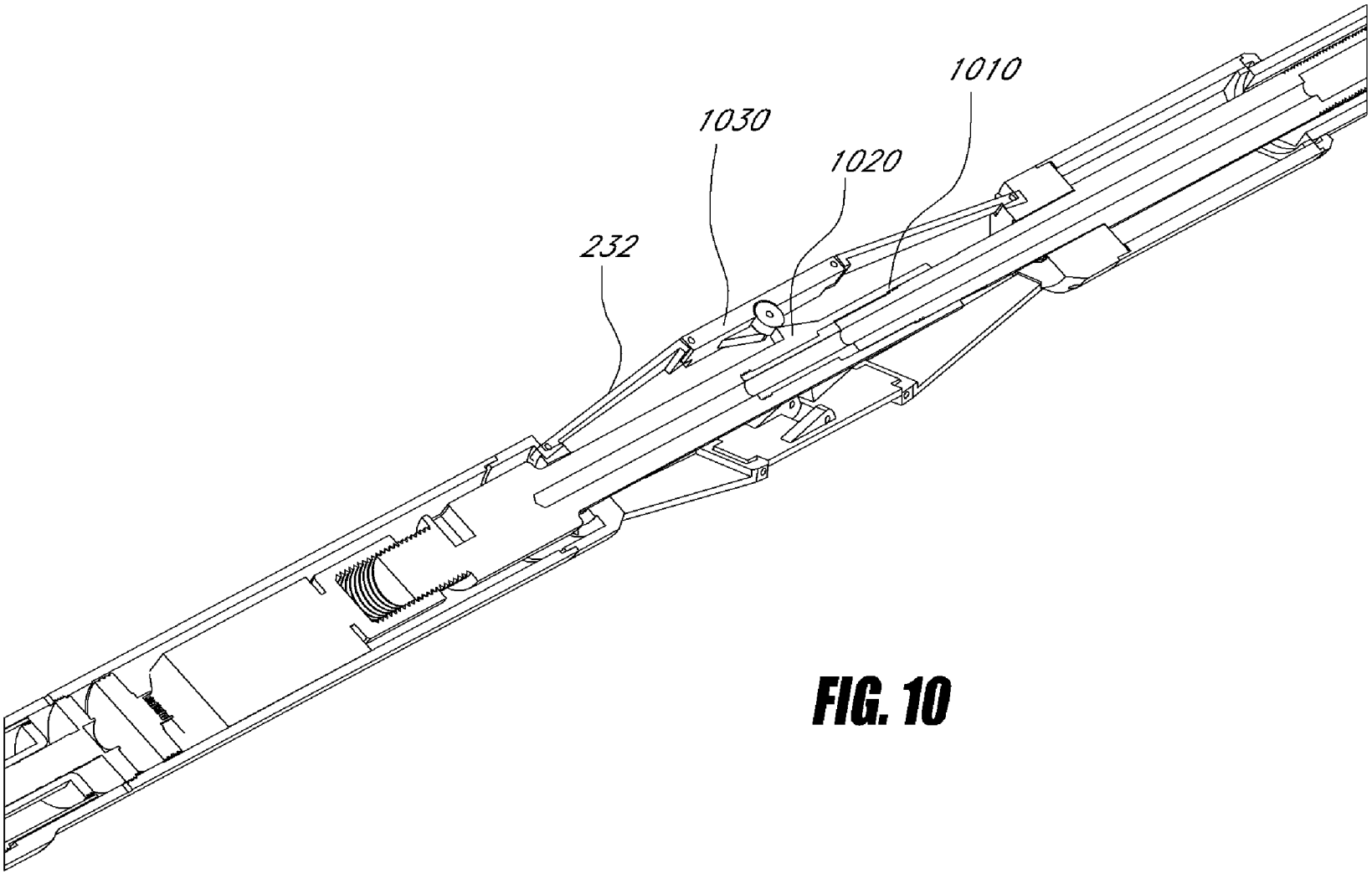
FIG. 10 is a perspective, sectional view of a gripper assembly illustrating an embodiment of a gripper expansion assembly employing passage-gripping elements with rollers that roll upon longitudinally moveable ramps.

FIG. 10 shows an embodiment having a gripper expansion assembly comprising a slider element 1010 coupled with respect to the extension element. Thus, the slider element 1010 moves longitudinally with the extension element. The illustrated slider element 1010 includes a plurality of ramps 1010. Each ramp 1010 is longitudinally movable with respect to the gripper motor 214. In this embodiment, each passage-gripping element is a flexible beam 232. A portion of each beam 232 interacts with an inclined surface of one of the ramps 1010 to move between the retracted and expanded positions of the beam. In the illustrated embodiment, each beam 232 includes a roller 1030 that rolls against the ramp 1010. The beams 232 flex radially outward as the rollers 1030 rolls against the ramps 1010.

Figure 11:
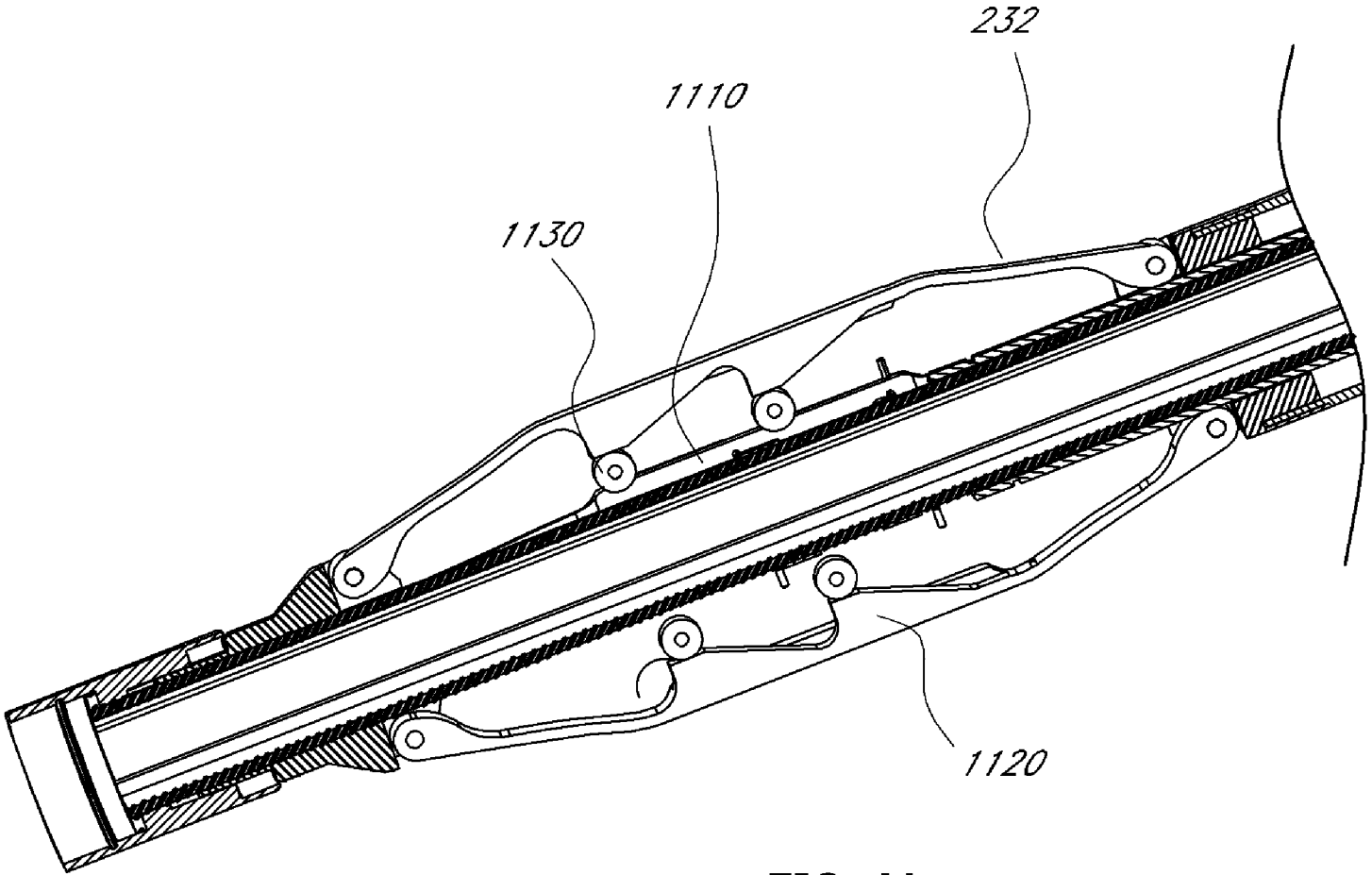
FIG. 11 is a sectional view of an embodiment of a gripper expansion assembly employing passage-gripping elements with ramps that roll upon longitudinally moveable rollers.

FIG. 11 shows an embodiment having a gripper expansion assembly comprising a slider element 1110 coupled with respect to the extension element (not shown). Thus, the slider element 1110 is longitudinally movable with respect to the gripper motor 214 (FIG. 2). The illustrated slider element 1110 has a plurality of rollers 1130. In this embodiment, each passage-gripping element comprises a flexible beam 232, and each beam 232 includes two ramps 1120 against which the rollers 1130 roll during longitudinal movement of the slider element 1110 with respect to the gripper motor 214. The rolling of the rollers 1130 against the ramps 1120 moves the beams 232 between their retracted and expanded positions.

Figure 12:
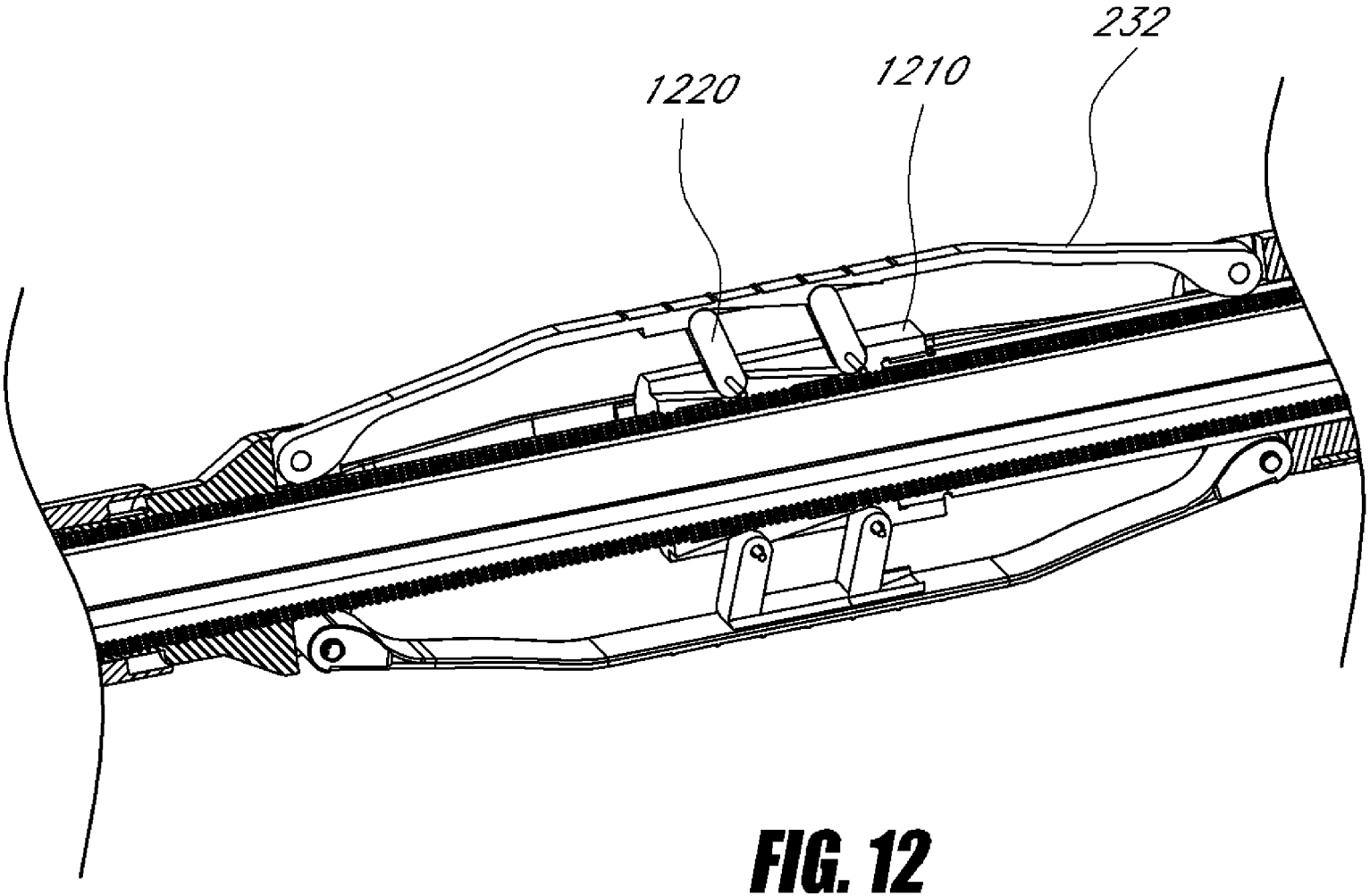
FIG. 12 is a sectional view of an embodiment of a gripper expansion assembly employing toggles for radially expanding passage-gripping elements.

FIG. 12 shows an embodiment having a gripper expansion assembly comprising a slider element 1210 coupled with respect to the extension element (not shown). The slider element 1210 is longitudinally moveable with respect to the gripper motor 214 (FIG. 2). In this embodiment, each passage-gripping element is a flexible beam 232. In the illustrated embodiment, a plurality of toggles 1220 is positioned between the slider element 1210 and the beams 232. Each toggle 1220 has a first end maintained on the slider element 1210, and a second end maintained on one of the beams 232. For example, the ends of the toggles 1220 can be pivotally secured to the slider element 1210 and the beams 232. An orientation of each toggle 1220 varies as the slider element 1210 moves longitudinally, such that the toggles 1220 push the beams 232 radially outward.

Further details and alternative configurations of the gripper expansion assemblies shown in FIGS. 10-12 are shown and described in U.S. Pat. No. 6,464,003 to Bloom et al.

Figure 13:
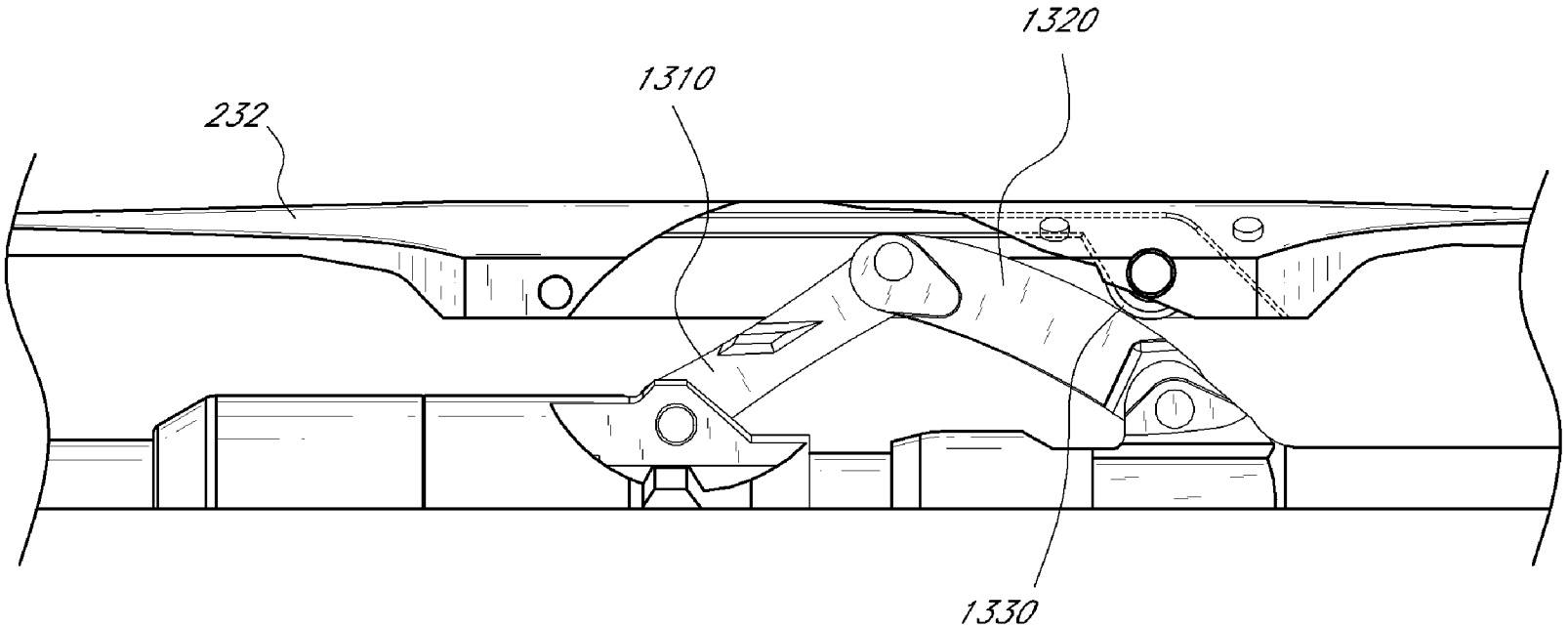
FIG. 13 is sectional view of an embodiment of a gripper expansion assembly employing an outwardly buckling linkage for radially expanding passage-gripping elements.

FIG. 13 shows an embodiment having a gripper expansion assembly comprising an expandable assembly that includes segments 1310 and 1320 pivotally connected in series. The expandable assembly is coupled with respect to the extension element (not shown) such that the expandable assembly is selectively moveable between a first position and a second position. In the first position, the segments 1310 and 1320 are substantially aligned and substantially parallel to the longitudinal axis of the tractor. In the second position, the segments 1310 and 1320 are buckled radially outward with respect to the longitudinal axis of the tractor. In this embodiment, the passage-gripping elements comprise flexible beams 232. A roller 1330 is coupled to each flexible beam 232 at an inner surface of the beam. Each roller 1330 is configured to roll upon an inclined portion of one of the segments 1320 to initiate radial expansion of the beam 232. When buckled radially outward, the segments 1310 and 1320 move the beams 232 to their expanded positions. In this context the term "buckled" means that the joint at which the linked segments 1310 and 1320 are connected moves radially outward. "Buckled" is not meant to imply mechanical failure in this context. Further details concerning the gripper expansion assembly of FIG. 13 are shown and described in U.S. Pat. No. 7,624,808 to Mock.

It will be appreciated that other known gripper expansion assemblies can be used in combination with embodiments of the gripper assembly 20. For example, a gripper assembly as shown and described in U.S. Patent Application No. 2005-0247488A1 to Mock et al. can be used. In another variation, a gripper assembly as shown and described in U.S. Patent Application Publication No. US2008-0149339A1 can be used.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A tractor for moving within a passage, comprising:

a body portion positioned along a longitudinal axis of the tractor;

a gripper assembly comprising:

a gripper motor having an output shaft adapted to rotate about a gripper motor axis during activation of the gripper motor;

a first gripper interface portion oriented substantially along the gripper motor axis;

a second gripper interface portion in engagement with the first gripper interface portion, wherein one of the first and second gripper interface portions comprises a gripper rotating element configured to rotate about the gripper motor axis during rotation of the output shaft relative to the gripper motor, the other of the first and second gripper interface portions comprising a gripper extension element being configured to move longitudinally with respect to the gripper motor during rotation of the output shaft relative to the gripper motor, due to said engagement between the first and second gripper interface portions; and at least two elongated gripping elements engaged with respect to the body portion, the gripping elements having a movement-limiting mode in which the gripping elements limit relative movement between the gripping elements and an inner surface of a passage, and a movement-permissive mode in which the gripping elements permit substantially free relative longitudinal movement between the gripping elements and the inner surface of the passage;

wherein the gripper extension element comprises part of a gripper expansion assembly for converting longitudinal motion of the gripper extension element into movement of the gripping elements between said movement-limiting mode and said movement-permissive mode of the gripping elements, the gripper assembly being configured to limit longitudinal movement of the body portion relative to the passage when the gripping elements are in said movement-limiting mode; and a gripper brake configured to lock the gripper assembly in its movement-limiting mode and to release the gripper assembly from its movement-limiting mode if electrical power to the gripper motor is interrupted;

wherein each of the gripping elements comprises:

an aft link having an aft portion that is rotatably connected to an aft toe anchor of the tractor, so that the aft portion of the aft link is substantially radially fixed with respect to the longitudinal axis of the tractor;

a passage-engaging link having an aft portion rotatably connected to a forward portion of the aft link; and a forward link having an aft portion that is rotatably connected to a forward portion of the passage-engaging link, the forward link having a forward portion that is rotatably connected to a forward toe anchor of the tractor, so that the forward portion of the forward link is substantially radially fixed with respect to the longitudinal axis of the tractor.

2. The tractor of claim 1, wherein the gripper brake comprises a mechanical locking device.

3. The tractor of claim 1, wherein the gripper brake has a first position in which the gripper brake locks the gripper assembly in its movement-limiting mode, and a second position in which the gripper brake releases the gripper assembly from its movement-limiting mode, the tractor further comprising a solenoid that causes the gripper brake to move to its second position if electrical power to the gripper motor is interrupted.

4. The tractor of claim 1, wherein the passage-engaging links of the gripping elements have roughened surfaces configured to frictionally engage a cased or uncased borehole passage.

5. The tractor of claim 1, further comprising a wireline connected with respect to the body portion, the wireline being configured to convey one or both of (1) electrical power for powering the gripper motor, and (2) electronic signals for controlling the gripper motor.

6. The tractor of claim 1, wherein the gripping elements have radially expanded positions relative to the tractor's longitudinal axis in said movement-limiting mode, and wherein the gripping elements are radially retracted from their radially expanded positions in said movement-permissive mode.

7. The tractor of claim 1, further comprising:

an alternate body portion positioned along the longitudinal axis of the tractor;

an alternate gripper assembly comprising:

an alternate gripper motor having an output shaft adapted to rotate about an alternate gripper motor axis during activation of the alternate gripper motor;

a first alternate gripper interface portion oriented substantially along the alternate gripper motor axis;

a second alternate gripper interface portion in engagement with the first alternate gripper interface portion, wherein one of the first and second alternate gripper interface portions comprises an alternate gripper rotating element configured to rotate about the alternate gripper motor axis during rotation of the alternate gripper motor's output shaft relative to the alternate gripper motor, the other of the first and second alternate gripper interface portions comprising an alternate gripper extension element being configured to move longitudinally with respect to the alternate gripper motor during rotation of the alternate gripper motor's output shaft relative to the alternate gripper motor, due to said engagement between the first and second alternate gripper interface portions; and at least two elongated alternate gripping elements engaged with respect to the alternate body portion, the alternate gripping elements having a movement-limiting mode in which the alternate gripping elements limit relative movement between the alternate gripping elements and the inner surface of the passage, and a movement-permissive mode in which the alternate gripping elements permit substantially free relative longitudinal movement between the alternate gripping elements and the inner surface of the passage;

wherein the alternate gripper extension element comprises part of an alternate gripper expansion assembly for converting longitudinal motion of the alternate gripper extension element into movement of the alternate gripping elements between said movement-limiting mode and said movement-permissive mode of the alternate gripping elements, the alternate gripper assembly being configured to limit longitudinal movement of the alternate body portion relative to the passage when the alternate gripping elements are in said movement-limiting mode; and an alternate gripper brake configured to lock the alternate gripper assembly in its movement-limiting mode and to release the alternate gripper assembly from its movement-limiting mode if electrical power to the alternate gripper motor is interrupted.

8. The tractor of claim 7, wherein the gripper brake and the alternate gripper brake each comprises a mechanical locking device.

9. The tractor of claim 7, wherein:

the gripper brake has a first position in which the gripper brake locks the gripper assembly in its movement-limiting mode, and a second position in which the gripper brake releases the gripper assembly from its movement-limiting mode;

the alternate gripper brake has a first position in which the alternate gripper brake locks the alternate gripper assembly in its movement-limiting mode, and a second position in which the alternate gripper brake releases the alternate gripper assembly from its movement-limiting mode; and the tractor further comprises a solenoid that causes at least one of the gripper brakes to move to its second position if electrical power to the gripper motor or the alternate gripper motor is interrupted.

10. A tractor for moving within a passage, comprising:

a body portion positioned along a longitudinal axis of the tractor;

a gripper assembly comprising:

a gripper motor having an output shaft adapted to rotate about a gripper motor axis during activation of the gripper motor;

a first gripper interface portion oriented substantially along the gripper motor axis;

a second gripper interface portion in engagement with the first gripper interface portion, wherein one of the first and second gripper interface portions comprises a gripper rotating element configured to rotate about the gripper motor axis during rotation of the output shaft relative to the gripper motor, the other of the first and second gripper interface portions comprising a gripper extension element being configured to move longitudinally with respect to the gripper motor during rotation of the output shaft relative to the gripper motor, due to said engagement between the first and second gripper interface portions; and at least two elongated gripping elements engaged with respect to the body portion, the gripping elements having a movement-limiting mode in which the gripping elements limit relative movement between the gripping elements and an inner surface of a passage, and a movement-permissive mode in which the gripping elements permit substantially free relative longitudinal movement between the gripping elements and the inner surface of the passage;

wherein the gripper extension element comprises part of a gripper expansion assembly for converting longitudinal motion of the gripper extension element into movement of the gripping elements between said movement-limiting mode and said movement-permissive mode of the gripping elements, the gripper assembly being configured to limit longitudinal movement of the body portion relative to the passage when the gripping elements are in said movement-limiting mode;

a gripper brake configured to lock the gripper assembly in its movement-limiting mode and to release the gripper assembly from its movement-limiting mode if electrical power to the gripper motor is interrupted, wherein the gripper brake has a first position in which the gripper brake locks the gripper assembly in its movement-limiting mode, and a second position in which the gripper brake releases the gripper assembly from its movement-limiting mode; and a solenoid that causes the gripper brake to move to its second position if electrical power to the gripper motor is interrupted.

11. A tractor for moving within a passage, comprising:

a body portion positioned along a longitudinal axis of the tractor;

a gripper assembly comprising:

a gripper motor having an output shaft adapted to rotate about a gripper motor axis during activation of the gripper motor;

a first gripper interface portion oriented substantially along the gripper motor axis;

a second gripper interface portion in engagement with the first gripper interface portion, wherein one of the first and second gripper interface portions comprises a gripper rotating element configured to rotate about the gripper motor axis during rotation of the output shaft relative to the gripper motor, the other of the first and second gripper interface portions comprising a gripper extension element being configured to move longitudinally with respect to the gripper motor during rotation of the output shaft relative to the gripper motor, due to said engagement between the first and second gripper interface portions; and at least two elongated gripping elements engaged with respect to the body portion, the gripping elements having a movement-limiting mode in which the gripping elements limit relative movement between the gripping elements and an inner surface of a passage, and a movement-permissive mode in which the gripping elements permit substantially free relative longitudinal movement between the gripping elements and the inner surface of the passage;

wherein the gripper extension element comprises part of a gripper expansion assembly for converting longitudinal motion of the gripper extension element into movement of the gripping elements between said movement-limiting mode and said movement-permissive mode of the gripping elements, the gripper assembly being configured to limit longitudinal movement of the body portion relative to the passage when the gripping elements are in said movement-limiting mode; and a gripper brake configured to lock the gripper assembly in its movement-limiting mode and to release the gripper assembly from its movement-limiting mode if electrical power to the gripper motor is interrupted;

wherein each of the gripping elements comprises a single flexible beam having opposing end portions that are each substantially fixed radially with respect to the longitudinal axis of the tractor.

12. A tractor for moving within a passage, comprising:

an aft body portion positioned along a longitudinal axis of the tractor;

an aft gripper assembly comprising:

an aft gripper motor having an output shaft adapted to rotate about an aft gripper motor axis during activation of the aft gripper motor;

a first aft gripper interface portion oriented substantially along the aft gripper motor axis;

a second aft gripper interface portion in engagement with the first aft gripper interface portion, wherein one of the first and second aft gripper interface portions comprises an aft gripper rotating element configured to rotate about the aft gripper motor axis during rotation of the aft gripper motor's output shaft relative to the aft gripper motor, the other of the first and second aft gripper interface portions comprising an aft gripper extension element being configured to move longitudinally with respect to the aft gripper motor during rotation of the aft gripper motor's output shaft relative to the aft gripper motor, due to said engagement between the first and second aft gripper interface portions; and at least two elongated aft gripping elements engaged with respect to the body portion, the aft gripping elements having a movement-limiting mode in which the aft gripping elements limit relative movement between the aft gripping elements and an inner surface of a passage, and a movement-permissive mode in which the aft gripping elements permit substantially free relative longitudinal movement between the aft gripping elements and the inner surface of the passage;

wherein the aft gripper extension element comprises part of an aft gripper expansion assembly for converting longitudinal motion of the aft gripper extension element into movement of the aft gripping elements between said movement-limiting mode and said movement-permissive mode of the aft gripping elements, the aft gripper assembly being configured to limit longitudinal movement of the body portion relative to the passage when the aft gripping elements are in said movement-limiting mode;

an aft gripper brake configured to lock the aft gripper assembly in its movement-limiting mode and to release the aft gripper assembly from its movement-limiting mode if electrical power to the aft gripper motor is interrupted;

a forward body portion positioned along the longitudinal axis of the tractor;

a forward gripper assembly comprising:

a forward gripper motor having an output shaft adapted to rotate about a forward gripper motor axis during activation of the forward gripper motor;

a first forward gripper interface portion oriented substantially along the forward gripper motor axis;

a second forward gripper interface portion in engagement with the first forward gripper interface portion, wherein one of the first and second forward gripper interface portions comprises a forward gripper rotating element configured to rotate about the forward gripper motor axis during rotation of the forward gripper motor's output shaft relative to the forward gripper motor, the other of the first and second forward gripper interface portions comprising a forward gripper extension element being configured to move longitudinally with respect to the forward gripper motor during rotation of the forward gripper motor's output shaft relative to the forward gripper motor, due to said engagement between the first and second forward gripper interface portions; and at least two elongated forward gripping elements engaged with respect to the forward body portion, the forward gripping elements having a movement-limiting mode in which the forward gripping elements limit relative movement between the forward gripping elements and the inner surface of the passage, and a movement-permissive mode in which the forward gripping elements permit substantially free relative longitudinal movement between the forward gripping elements and the inner surface of the passage;

wherein the forward gripper extension element comprises part of a forward gripper expansion assembly for converting longitudinal motion of the forward gripper extension element into movement of the forward gripping elements between said movement-limiting mode and said movement-permissive mode of the forward gripping elements, the forward gripper assembly being configured to limit longitudinal movement of the forward body portion relative to the passage when the forward gripping elements are in said movement-limiting mode; and a forward gripper brake configured to lock the forward gripper assembly in its movement-limiting mode and to release the forward gripper assembly from its movement-limiting mode if electrical power to the forward gripper motor is interrupted;

wherein:

the aft gripper brake has a first position in which the aft gripper brake locks the aft gripper assembly in its movement-limiting mode, and a second position in which the aft gripper brake releases the aft gripper assembly from its movement-limiting mode;

the forward gripper brake has a first position in which the forward gripper brake locks the forward gripper assembly in its movement-limiting mode, and a second position in which the forward gripper brake releases the forward gripper assembly from its movement-limiting mode; and the tractor further comprises a solenoid that causes at least one of the gripper brakes to move to its second position if electrical power to the aft gripper motor or the forward gripper motor is interrupted.

* * * * *

UNITED STATES PATENT AND TRADEMARK OFFICE

CERTIFICATE OF CORRECTION

PATENT NO. : 8,028,766 B2
APPLICATION NO. : 12/840166
DATED : October 4, 2011
INVENTOR(S) : Norman Bruce Moore It is certified that error appears in the above-identified patent and that said Letters Patent is hereby corrected as shown below:

At column 1, line 47, please change ""borehole"are" to --"borehole" are--.

At column 21, line 38, please change "Carnesca" to --Camesca--.

At column 21, line 40, please change "Carnesca" to --Camesca--.

At column 21, line 65, please change "preventingress" to --prevent ingress--.

Signed and Sealed this
Eleventh Day of September, 2012

David J. Kappos

David J. Kappos
*Director of the United States Patent and Trademark Office*